US006361271B1

(12) United States Patent
Bosley

(10) Patent No.: US 6,361,271 B1
(45) Date of Patent: Mar. 26, 2002

(54) CROSSING SPIRAL COMPRESSOR/PUMP

(75) Inventor: Robert W. Bosley, Cerritos, CA (US)

(73) Assignee: Capstone Turbine Corporation, Chatsworth, CA (US)

( * ) Notice: Subject to any disclaimer, the term of this patent is extended or adjusted under 35 U.S.C. 154(b) by 0 days.

(21) Appl. No.: 09/444,014

(22) Filed: Nov. 19, 1999

(51) Int. Cl.[7] ..... F01D 5/00
(52) U.S. Cl. ..... 415/72; 416/235
(58) Field of Search ..... 415/71, 72, 73, 415/74, 75, 92; 416/181, 182, 235, 183

(56) References Cited

U.S. PATENT DOCUMENTS

| | | | | |
|---|---|---|---|---|
| 649,546 | A | 5/1900 | Porter | |
| 1,665,687 | A | 4/1928 | Derrick | |
| 1,990,059 | A | 2/1935 | Bertin | |
| 2,319,776 | A | 5/1943 | Copeland et al. | 103/96 |
| 2,842,062 | A | 7/1958 | Wright | 103/96 |
| 3,746,350 | A | 7/1973 | Mayer et al. | |
| 4,230,438 | A | 10/1980 | Lehman et al. | 415/122 R |
| 4,948,344 | A | 8/1990 | Cygnor | 417/279 |
| 5,160,249 | A | 11/1992 | Iwai et al. | 415/55.3 |
| 5,240,372 | A | 8/1993 | Krienke | |
| 5,456,574 | A | 10/1995 | Donnelly et al. | 415/28 |

*Primary Examiner*—F. Daniel Lopez
*Assistant Examiner*—James M McAleenan
(74) *Attorney, Agent, or Firm*—Irell & Manella LLP

(57) ABSTRACT

A crossing spiral compressor or pump having a cylindrical rotor rotating within a cylindrical stator bore. Both the outer surface of the rotor and the bore of the stator include a plurality of spiral fluid flow channels separated by narrow blades, with the spiral fluid flow channels of the stator bore spiraling in the reverse or opposite direction relative to the spiral fluid flow channels of the rotor. The fluid flow channels on the rotor and in the bore have open sides that face the annular gap between the rotor and stator with the channels crossing each other at many locations to facilitate fluid exchange between rotor channels and bore channels.

66 Claims, 15 Drawing Sheets

CROSSING SPIRAL COMPRESSOR/PUMP

TECHNICAL FIELD

This invention relates to the general field of compressors and pumps and more particularly to a compressor/pump having a crossing spiral fluid flow path.

BACKGROUND OF THE INVENTION

A crossing spiral compressor/pump is a high-speed rotary machine that accomplishes compression or pressurization of fluid by imparting a velocity head to each fluid particle as it passes through the machine's rotor flow channels and then converting that velocity head into a pressure head in the bore flow channels of a stator housing that function as vaneless diffusers. While in this respect a crossing spiral compressor/pump has some characteristics in common with a centrifugal compressor or centrifugal pump, the primary flow in a crossing spiral compressor/pump is axial with a double helical spin, while in a centrifugal compressor the primary flow is radial with no spin. The fluid particles passing through a crossing spiral compressor/pump travel in a tight pitch helical flow pattern within loosely pitched spiral flow channels on the outside of the rotor and inside the stator housing bore. The rotor flow channels are essentially half circles with their open surface facing outward adjacent to the bore flow channels. The bore flow channels are essentially half circles with their open surfaces facing inward adjacent to the rotor flow channels. The adjacent rotor and bore flow half circle flow channels function together as a combined channel that is essentially circular. Within the combined channels, the fluid particles travel along helical streamlines, the centerline of the helix coinciding with the center of the combined rotor and bore spiral channels. This flow pattern causes each fluid particle to pass through the rotor channels many times while the fluid particles are traveling through the crossing spiral compressor/pump, each time acquiring kinetic energy. After each pass through the rotor flow channels, the fluid particles reenter the adjacent stator housing bore channels where they convert their kinetic or velocity energy into potential or pressure energy. This produces an axial pressure gradient in the rotor and stator housing bore flow channels.

The multiple passes through the rotor flow channels (regenerative flow pattern) allows a crossing spiral compressor/pump to produce discharge heads of up to fifteen (15) times those produced by a centrifugal compressor operating at equal tip speeds. Since the cross-sectional area of the flow channels in a crossing spiral compressor/pump is usually smaller than the cross-sectional area of the radial flow in a centrifugal compressor, a crossing spiral compressor/pump would normally operate at flows which are lower than the flows of a centrifugal compressor having an equal impeller diameter and operating at an equal tip speed. These high-head, low-flow performance characteristics of a crossing spiral compressor/pump make it well suited to a number of applications where a reciprocating compressor, a rotary displacement compressor, or a low specific-speed centrifugal compressor would not be as well suited.

A crossing spiral compressor/pump can be utilized as a turbine by supplying it with a high pressure working fluid, dropping fluid pressure through the machine, and extracting the resulting shaft horsepower with a generator. Hence the terms "compressor/turbine" or "pump/turbine" are used throughout this application. During normal operation, the crossing spiral machine can be converted from a compressor/pump into a turbine by reducing and reversing the discharge head pressure.

Among the advantages of a crossing spiral compressor/pump or a crossing spiral turbine are:

(a) simple, reliable design with only one rotating assembly;

(b) stable, surge-free operation over a wide range of operating conditions (i.e. from full flow with low discharge head pressure to no flow with high discharge head pressure)

(c) long operating life (e.g., 40,000 hours) limited mainly by their bearings;

(d) freedom from wear product and oil contamination since there are no rubbing or lubricated surfaces utilized;

(e) only one stage required compared to multi-stage centrifugal compressor/pump assemblies of equal pressure rise and speed; and (f) higher operating efficiencies when compared to a very low specific-speed (high head pressure, low flow, and low impeller speed) centrifugal compressor.

On the other hand, a crossing spiral compressor/pump or turbine cannot compete with a moderate to high specific-speed centrifugal compressor, in view of their relative efficiencies. While the best efficiency of a centrifugal compressor at a high specific-speed (low head and high flow) operating condition would be on the order of seventy-eight percent (78%), at a low specific-speed operating condition a centrifugal compressor could have an efficiency of less than twenty percent (20%). A crossing spiral compressor/pump operating at the same low specific-speed and at its best flow can have efficiencies of about fifty-five percent (55%)

The flow in a crossing spiral compressor/pump can be visualized as two fluid streams that first merge and then divide as they pass through the compressor/pump.

While the unique capabilities of a crossing spiral compressor/pump would seem to offer many applications, the low flow limitation severely curtail their widespread utilization.

Permanent magnet motors and generators, on the other hand, are used widely in many varied applications. This type of motor/generator has a stationary field coil and a rotatable armature of permanent magnet(s). In recent years, high energy product permanent magnets having significant energy increases have become available. Samarium cobalt permanent magnets having an energy product of twenty-seven (27) megagauss-oersted (mgo) are now readily available and neodymium-iron-boron magnets with an energy product of thirty-five (35) megagauss-oersted are also available. Even further increases of mgo to over 45 megagauss-oersted promise to be available soon. The use of such high energy product permanent magnets permits smaller machines capable of supplying higher power outputs.

The permanent magnet rotor may comprise a plurality of equally spaced magnetic poles of alternating polarity or may even be a sintered one-piece magnet with radial orientation. The stator would normally include a plurality of windings and magnet poles of alternating polarity. In a generator mode, rotation of the rotor causes the permanent magnets to pass by the stator poles and coils and thereby induces an electric current to flow in each of the coils. In the motor mode, electrical current is passed through the coils, which will cause the permanent magnet rotor to rotate.

SUMMARY OF THE INVENTION

A crossing spiral flow path compressor is a rotary machine having a rotor disposed to rotate within a stator housing bore, with the rotor having a plurality of channels spiraling in one direction and the stator housing bore having a plurality of channels spiraling in the reverse or opposite direction. The rotor and stator housing bore channels would be separated by narrow blades (significantly narrower than the width of the channels) with minimal blocking of back-flow around the blades.

The crossing spiral compressor/pump may be integrated with a permanent magnet motor/generator to achieve fluid dynamic characteristics that are otherwise not readily obtainable. The crossing spiral compressor/pump and permanent magnet motor/generator are disposed in a housing with the crossing spiral compressor/pump at one end and typically the permanent magnet motor/generator at the other end. The crossing spiral compressor/pump rotor and the permanent magnet rotor form a common rotor which is rotatable mounted within this housing typically by bearings at the ends of the common rotor. Alternately, the common rotor may be supported by bearings at the ends of the crossing spiral compressor/pump section of the rotor with the motor/generator section of the rotor overhanging the bearing located between the compressor/pump and the motor/generator.

In one embodiment the flow is introduced at one end and passes through the entire axial length of the rotor and stator housing bore channels while in another embodiment the flow is introduced at the midpoint of the rotor and stator housing bore channels and travels in both directions away from the midpoint. Alternately, flow can be introduced at both ends of the rotor and bore channels.

It is therefore, a principal aspect of the present invention to provide an improved compressor or pump that utilizes spiral flow channels to induce fluid flow and pressure rise within the fluid.

It is another aspect of the present invention to provide a compressor or pump that has a nominally cylindrical rotor.

It is another aspect of the present invention to provide a compressor or pump that has a nominally cylindrical bore in the interior of a non-rotating stator housing within which the rotor rotates.

It is another aspect of the present invention to provide a compressor or pump that has spiral fluid flow channels on the outer surface of the cylindrical rotor.

It is another aspect of the present invention to provide a compressor or pump that has spiral fluid flow channels on the inner surface of the cylindrical bore.

It is another aspect of the present invention to provide a compressor or pump that has spiral fluid flow channels on the inner surface of the cylindrical bore that spiral in the reverse or opposite direction relative to the spiral fluid flow channels on the outer surface of the cylindrical rotor.

It is another aspect of the present invention to provide a compressor or pump wherein each spiral fluid flow channel on the outer surface of the cylindrical rotor crosses many of the spiral fluid flow channels on the inner surface of the cylindrical bore.

It is another aspect of the present invention to provide a compressor or pump wherein each spiral fluid flow channel on the inner surface of the cylindrical bore crosses many of the spiral fluid flow channels on the outer surface of the cylindrical rotor.

It is another aspect of the present invention to provide a crossing spiral compressor or pump wherein each spiral fluid flow channel on the outer surface of the cylindrical rotor has a cross section normal to the spiral axis of that channel that resembles a half circle with the opening facing the inner surface of the bore.

It is another aspect of the present invention to provide a crossing spiral compressor or pump wherein each spiral fluid flow channel on the inner surface of the cylindrical bore has a cross section normal to the spiral axis of that channel that resembles a half circle with the opening facing the outer surface of the rotor.

It is another aspect of the present invention to provide a crossing spiral compressor or pump wherein the crossing intersections of the spiral fluid flow channels on the outer surface of the cylindrical rotor with the spiral fluid flow channels on the inner surface of the cylindrical bore form an elliptical combined fluid flow channel normal to the rotational axis of the rotor.

It is another aspect of the present invention to provide a crossing spiral compressor or pump wherein the rotation of the rotor within the stator housing bore and the crossing intersections of the spiral fluid flow channels on the rotor and in the bore induce fluid flow along the axis of the rotor's rotation within the channeled annulus formed between the rotor and bore.

It is another aspect of the present invention to provide a crossing spiral compressor or pump wherein the rotation of the rotor within the stator housing bore and the crossing intersections of the spiral fluid flow channels on the rotor and in the bore induce a pressure rise in the fluid as the fluid moves through the crossing spiral compressor/pump.

It is another aspect of the present invention to provide a crossing spiral compressor wherein the cross sectional area of the fluid flow channels (either or both the rotor or bore) decrease from the inlet (low pressure) end to the outlet (high pressure) end of the crossing spiral compressor to compensate for increasing fluid density.

It is another aspect of the present invention to provide a crossing spiral compressor or pump wherein the fluid dynamic blades separating each fluid flow channel from the adjacent fluid flow channels are narrow in comparison to the width of the fluid flow channels on either side (for both the fluid flow channels on the outer surface of the rotor and the fluid flow channels on the inner surface of the stator housing bore).

It is another aspect of the present invention to provide a crossing spiral compressor or pump wherein the fluid dynamic blades separating each fluid flow channel from the adjacent fluid flow channels do not, by virtue of their width, form seals that resist fluid flow from one channel on the rotor to either of the adjacent channels on the rotor or from one channel in the stator housing bore to adjacent channels in the stator housing bore.

It is another aspect of the present invention to provide a crossing spiral compressor or pump wherein the fluid in the rotor flow channels leaves those channels and enters the stator housing bore flow channels at the crossing intersections of the rotor and the bore fluid flow channels.

It is another aspect of the present invention to provide a crossing spiral compressor or pump wherein the fluid in the stator housing bore flow channels leaves those channels and enters the rotor flow channels at the crossing intersections of the bore and the rotor fluid flow channels.

It is another aspect of the present invention to provide a crossing spiral compressor or pump wherein the fluid leaving the rotor flow channels and entering the stator housing bore flow channels at the crossing intersections of the rotor and the bore fluid flow channels and the fluid leaving the stator housing bore flow channels and entering the rotor flow channels at the crossing intersections of the rotor and the bore fluid flow channels will have a combined flow pattern whose component normal to the rotor's rotation axis is essentially a spinning motion that follows the elliptical shape of the combined fluid flow channel.

It is another aspect of the present invention to provide a crossing spiral compressor or pump wherein the rotation of the rotor within the stator housing bore induces the fluid in the stator housing bore fluid flow channels to spin about the bore fluid flow channel's spiral axis.

It is another aspect of the present invention to provide a crossing spiral compressor or pump wherein the rotation of the rotor within the stator housing bore induces the fluid in the rotor fluid flow channels to spin about the rotor fluid flow channel's spiral axis.

It is another aspect of the present invention to provide a crossing spiral compressor or pump wherein the rotor fluid flow channels convert rotor shaft power into fluid kinetic or velocity energy as would a centrifugal compressor or pump impeller.

It is another aspect of the present invention to provide a crossing spiral compressor or pump wherein the high velocity fluid that has just left the rotor fluid flow channels and has just entered the stator housing bore fluid flow channels will have much of its kinetic or velocity energy converted into potential or pressure energy by the stationary stator housing bore fluid flow channels that function in a manner similar to a vaneless diffuser in a centrifugal compressor or pump.

It is another aspect of the present invention to provide a crossing spiral compressor or pump wherein the spiral flow patterns of the fluid in the rotor fluid flow channels, the spiral flow pattern of the fluid in the stator housing bore fluid flow channels, and the spiral flow pattern of the fluid in the elliptical combined fluid flow area where the rotor and the stator housing fluid flow channels cross, will cause the fluid passing through the compressor or pump to alternately pass through the rotor fluid flow channels and through the stator housing bore fluid flow channels and then repeat this sequence several more times before exiting the compressor or pump.

It is another aspect of the present invention to provide a crossing spiral compressor or pump wherein the spiral flow patterns of the fluid in the compressor or pump can be characterized as vortex flow patterns, regenerative flow patterns, or multi-pass flow patterns since the fluid passes many times through the rotor and bore fluid flow channels (alternately through each type of channel) as the fluid passes through the compressor or pump.

It is another aspect of the present invention to provide a crossing spiral compressor or pump wherein the fluid passing through the compressor or pump will experience a conversion of kinetic or velocity energy into potential or pressure energy every time the fluid passes through the stator housing bore flow channels.

It is another aspect of the present invention to provide a crossing spiral compressor or pump wherein the pressure rise in the fluid passing through the compressor or pump can be many times the pressure rise of fluid passing through a single pass centrifugal compressor or pump of equal tip speed (impeller circumference times impeller revolutions per second) owing to the multi-pass nature of the present invention.

It is another aspect of the present invention to provide a crossing spiral compressor or pump wherein the rotor tip speed and usually the rotor rpm can be much lower than for a single pass centrifugal compressor or pump of equal pressure rise and flow rate, owing to the multi-pass nature of the present invention.

It is another aspect of the present invention to provide a crossing spiral compressor or pump which operates at such a low speed that the rotor bearing requirements may be satisfied by utilizing grease packed ball bearings.

It is another aspect of the present invention to provide a crossing spiral compressor or ump wherein, when operating at its highest flow and lowest pressure rise capability, the spiral flow patterns of the fluid flowing through the compressor or pump will have a loose pitch with a minimum of flow passes through the rotor.

It is another aspect of the present invention to provide a crossing spiral compressor or pump wherein, when operating at its highest flow and lowest pressure rise capability, the fluid flow passing through the rotor flow channels will experience increases in its kinetic or velocity energy during its entire period of passage through these channels.

It is another aspect of the present invention to provide a crossing spiral compressor or pump wherein, when operating at its highest flow and lowest pressure rise capability, the fluid flow passing through the stator housing bore flow channels will experience conversion of its kinetic or velocity energy into potential or pressure energy during its entire period of passage through these channels.

It is another aspect of the present invention to provide a crossing spiral compressor or pump wherein, when operating at its lowest flow and highest pressure rise capability, the spiral flow patterns of the fluid flowing through the compressor or pump will have a tight pitch with a maximum of flow passes through the rotor.

It is another aspect of the present invention to provide a crossing spiral compressor or pump wherein, when operating at its lowest flow and highest pressure rise capability, the fluid flow passing through the rotor flow channels will experience increases in its kinetic or velocity energy only during the latter part of its passage through these channels. During the earlier part of its passage through these channels, these channels behave as rotating diffusers, converting the kinetic or velocity energy (associated with the backwards flow exiting the stator housing bore fluid flow channels and entering the rotor fluid flow channels) into potential or pressure energy.

It is another aspect of the present invention to provide a crossing spiral compressor or pump wherein, when operating at its lowest flow and highest pressure rise capability, the fluid flow passing through the stator housing bore flow channels will experience conversion of its kinetic or velocity energy into potential or pressure energy only during the earliest part of its passage through these channels. During the latter part of its passage through these channels, these channels behave as nozzles, converting the fluid's potential or pressure energy into kinetic or velocity energy and producing a local flow with an axial component opposed to the general fluid flow through the compressor or pump.

It is another aspect of the present invention to provide a crossing spiral compressor or pump wherein the blades at the radial flow entry point of the rotor fluid flow channels can have either a radial slope or a forward leaning slope. The forward leaning slope can reduce fluid shock losses and will result in a rotor fluid flow channel cross section that deviates moderately from that of a half circle. The radial slope can have manufacturing advantages and will result in a rotor fluid flow channel cross section that approximates that of a half circle.

It is another aspect of the present invention to provide a crossing spiral compressor or pump wherein the blades at the radial flow entry point of the stator housing bore fluid flow channels can have either a radial slope or a forward leaning slope. The forward leaning slope can reduce fluid shock losses and will result in a stator housing bore fluid flow channel cross section that deviates moderately from that of a half circle. The radial slope can have manufacturing advantages and will result in a stator housing bore fluid flow channel cross section that approximates that of a half circle.

It is another aspect of the present invention to provide a crossing spiral compressor wherein the pitch of the rotor fluid flow channel spiral can vary from one end of the rotor to the other end, typically having a tighter pitch and a reduced channel cross-sectional area at the high pressure end.

It is another aspect of the present invention to provide a crossing spiral compressor wherein the cross-sectional area of the rotor fluid flow channel is reduced as the fluid flow approaches the fluid exit.

It is another aspect of the present invention to provide a crossing spiral compressor wherein the cross-sectional area of the stator fluid flow channel is reduced as the fluid flow approaches the fluid exit.

It is another aspect of the present invention to provide a crossing spiral compressor wherein the pitch of the stator housing bore fluid flow channel spiral can vary from one end of the rotor to the other end, typically having a tighter pitch and a reduced channel cross-sectional area at the high pressure end.

It is another aspect of the present invention to provide a crossing spiral compressor or pump wherein, in the first embodiment, the fluid flow enters one end of the rotor and stator housing bore fluid flow channels and exits the other end of the fluid flow channels.

It is another aspect of the present invention to provide a crossing spiral compressor or pump wherein, in the first embodiment, the single direction of fluid flow results in a fluid generated thrust load on the rotor bearings equal to pi times the square of the rotor radius times the differential fluid pressure across the compressor or pump.

It is another aspect of the present invention to provide a crossing spiral compressor or pump wherein, in the first embodiment, it is desirable to minimize the diameter of the rotor to minimize the axial load that the thrust bearings must support.

It is another aspect of the present invention to provide a crossing spiral compressor or pump wherein, in the second embodiment, the fluid flow enters at the mid point of the crossing spiral compressor/pump rotor and stator housing bore fluid flow channels and exits at both ends of the fluid flow channels (or alternately, enters at both ends and exits at the mid point of the crossing spiral compressor/pump rotor and stator housing bore).

It is another aspect of the present invention to provide a crossing spiral compressor or pump wherein, in the second embodiment, the bi-directional fluid flow path results in generating minimal to no fluid generated thrust load on the rotor bearings.

It is another aspect of the present invention to provide a crossing spiral compressor or pump wherein, in the second embodiment, it is desirable to utilize a larger diameter for the rotor than with the first embodiment since thrust load is not a problem and it allows the length of the rotor for bi-directional flow to be reduced.

It is another aspect of the present invention to provide a crossing spiral rotary machine that can function as a compressor or pump or can function as a turbine for either compressible or incompressible fluids.

It is another aspect of the present invention to provide a crossing spiral compressor or pump wherein the compressor or pump is driven by an integrated permanent magnet motor/generator.

It is another aspect of the present invention to provide a crossing spiral compressor or pump wherein the compressor or pump is driven by a permanent magnet motor/generator having a motor/generator stator that is integrally mounted within the compressor or pump housing and a motor/generator rotor that is mounted on a common shaft with the compressor or pump rotor and the integrated compressor/motor/generator or pump/motor/generator share common bearings.

It is another aspect of the present invention to provide a crossing spiral compressor or pump integrated with a permanent magnet motor/generator wherein the motor/generator is driven by a bidirectional inverter which can provide power to the motor or extract power from the generator.

It is another aspect of the present invention to provide a crossing spiral compressor or pump integrated with a permanent magnet motor/generator and utilized with a bi-directional inverter wherein gaseous fluids are compressed or expanded.

It is another aspect of the present invention to provide a crossing spiral compressor or pump integrated with a permanent magnet motor/generator and utilized with a bi-directional inverter wherein liquid fluids are pressurized or depressurized.

It is another aspect of the present invention to provide a crossing spiral compressor or pump integrated with a permanent magnet motor/generator and utilized with a bi-directional inverter wherein electrical power is utilized to produce fluid power when the fuel (either gaseous or liquid) supplied to the inlet of the compressor or pump is at a lower pressure than that needed at the outlet of the compressor or pump.

It is another aspect of the present invention to provide a crossing spiral compressor or pump functioning as a turbine and integrated with a permanent magnet motor/generator and utilized with a bi-directional inverter wherein electrical power can be generated when the fuel (either gaseous or liquid) supplied to the inlet of the compressor or pump is at a greater pressure than that needed at the outlet of the compressor or pump.

It is another aspect of the present invention to provide a crossing spiral compressor or pump integrated with a permanent magnet motor/generator and utilized with a bi-directional inverter that can shift or transition smoothly from generating electrical power while expanding or depressurizing the working fluid to utilizing electrical power to compress or pressurize the working fluid in response to changes in the supplied inlet fluid pressure and/or the required outlet fluid pressure.

It is another aspect of the present invention to provide a crossing spiral compressor or pump integrated with a permanent magnet motor/generator and utilized with a bidirectional inverter that can precisely control the shaft speed of the compressor or pump.

It is another aspect of the present invention to provide a crossing spiral compressor or pump integrated with a permanent magnet motor/generator and utilized with a bi-directional inverter that can precisely control the shaft torque delivered to or extracted from the compressor/pump by the motor/generator.

It is another aspect of the present invention to provide a crossing spiral compressor or pump integrated with a permanent magnet motor/generator and utilized with a bi-directional inverter that can precisely control the pressure change that occurs as the fluid passes through the compressor or pump.

It is another aspect of the present invention to provide a crossing spiral compressor or pump integrated with a permanent magnet motor/generator and utilized with a bi-directional inverter that can precisely control the fluid energy change that occurs as the fluid passes through the compressor or pump (e.g. by controlling the product of shaft speed and shaft torque).

It is another aspect of the present invention to provide a crossing spiral compressor or pump integrated with a permanent magnet motor/generator and utilized with a bi-directional inverter that can provide volumetric fluid flow rate data for the fluid passing through the compressor or pump (e.g. by monitoring the shaft speed and shaft torque).

It is another aspect of the present invention to provide a crossing spiral compressor/turbine or pump/turbine that does not experience fluid dynamic stall or surge instabilities such as are experienced by centrifugal compressors/pumps/turbines when process fluid flows are low and the pressure changes experienced by the process fluid when passing through these devices are large.

It is another aspect of the present invention to provide a crossing spiral compressor/turbine or pump/turbine that does not produce pressure pulsations or flow pulsations such as those produced by reciprocating compressors.

It is another aspect of the present invention to provide a crossing spiral compressor/turbine or pump/turbine that does not need to be turned on and off in order to is control fluid pressure discharge pressure such as can be the case with reciprocating compressors driven by constant speed motors when fluid delivery flow rates must vary.

It is another aspect of the present invention to provide a crossing spiral compressor/turbine or pump/turbine that does not need an accumulator in order to limit fluid discharge pressure pulsations (e.g. caused by compressor or pump piston strokes) and to limit fluid discharge pressure variations (e.g. caused by variations in the required process fluid delivery flow and by turning the compressor/pump/turbine on and off).

It is another aspect of the present invention to provide a crossing spiral compressor/turbine or pump/turbine that has no rubbing rings, seals or other hardware that can wear.

It is another aspect of the present invention to provide a crossing spiral compressor/turbine or pump/turbine that does not utilize oil lubrication other than grease in ball bearings and does not discharge oil vapors with the process fluid.

It is another aspect of the present invention to provide a crossing spiral compressor/turbine or pump/turbine that produces a large pressure change in the process fluid with low rotor tip speeds.

It is another aspect of the present invention to provide a crossing spiral compressor/turbine or pump/turbine that operates at reasonably high efficiencies when machine specific speed is low (i.e. when pressure change is high, flow is low and tip speed is low) which is a condition where centrifugal compressors perform poorly.

It is another aspect of the present invention to provide a crossing spiral compressor/turbine or pump/turbine integrated with a permanent magnet motor/generator and utilized with a bi-directional inverter that is efficient in fluid dynamic energy conversion and efficient in electrical power utilization and generation over the entire operating ranges for pressure, flow and speed. A bi-directional inverter, sometimes called a four quadrant inverter, is capable of putting power into the permanent magnet motor or taking power out of the permanent magnet generator.

It is another aspect of the present invention to provide a compressor/turbine or pump/turbine that can operate from no flow with maximum pressure change across the machine to full flow with minimum pressure change across the machine with no instabilities or discontinuities in the pressure/flow characteristics.

It is another aspect of the present invention to provide a compressor/turbine or pump/turbine integrated with a permanent magnet motor/generator and utilized with a bidirectional inverter that can quickly and continuously adjust its process fluid throughput flow rate to match requirements.

It is another aspect of the present invention to provide a crossing spiral compressor or pump integrated with a permanent magnet motor/generator and utilized with a bidirectional inverter wherein gaseous fuels for a turbogenerator are compressed or expanded.

It is another aspect of the present invention to provide a crossing spiral compressor or pump integrated with a permanent magnet motor/generator and utilized with a bidirectional inverter wherein liquid fuels for a turbogenerator are pressurized or depressurized.

It is another aspect of the present invention to provide a crossing spiral compressor or pump integrated with a permanent magnet motor/generator and utilized with a bi-directional inverter wherein gaseous fuel for a turbogenerator is compressed or expanded to precisely control the fuel pressure or mass flow required by the turbogenerator.

It is another aspect of the present invention to provide a crossing spiral compressor or pump integrated with a permanent magnet motor/generator and utilized with a bi-directional inverter wherein liquid fuel for a turbogenerator is pressurized or depressurized to precisely control the fuel pressure or mass flow required by the turbogenerator.

BRIEF DESCRIPTION OF THE DRAWINGS

Figure 1:
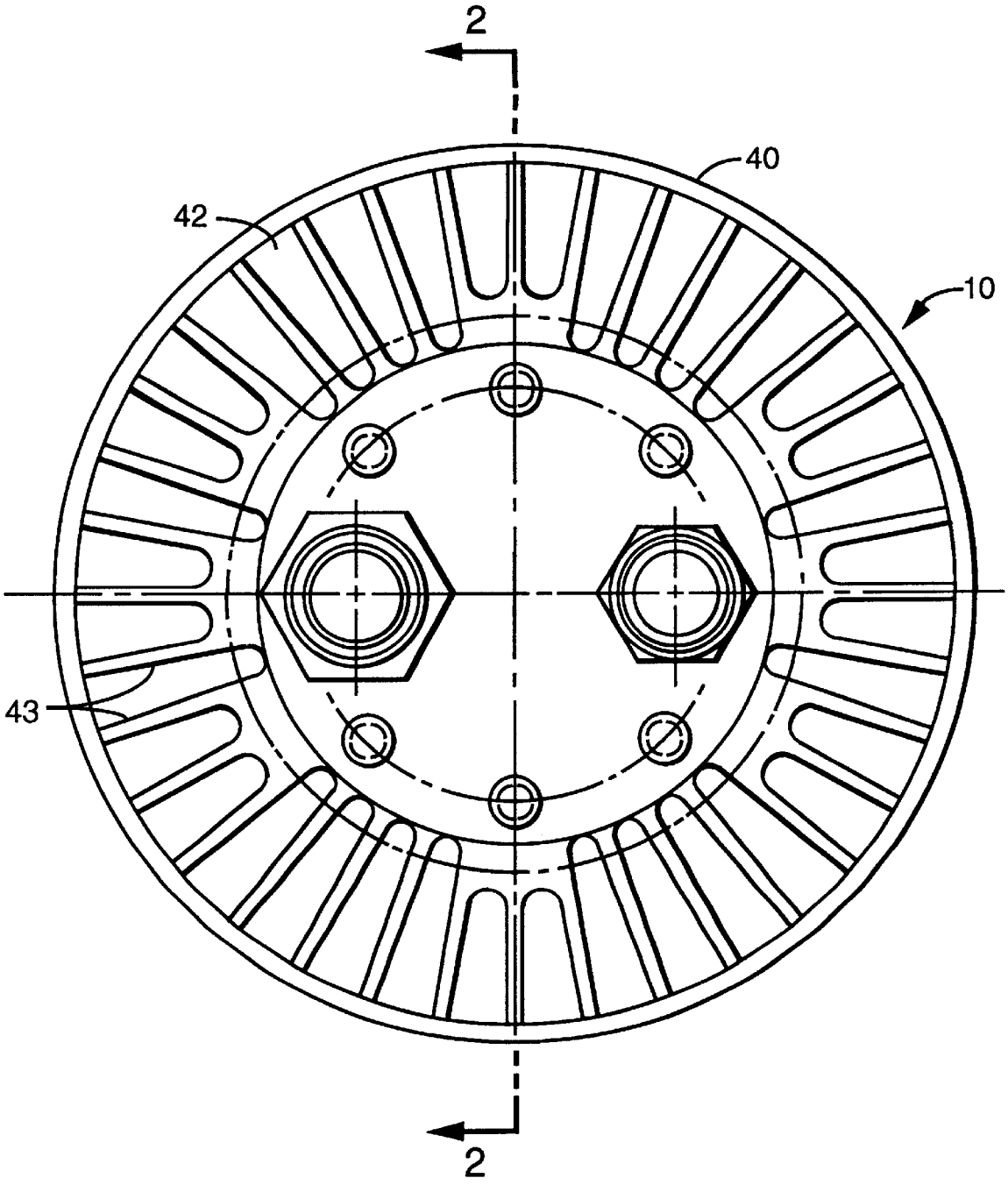
Figure 2:
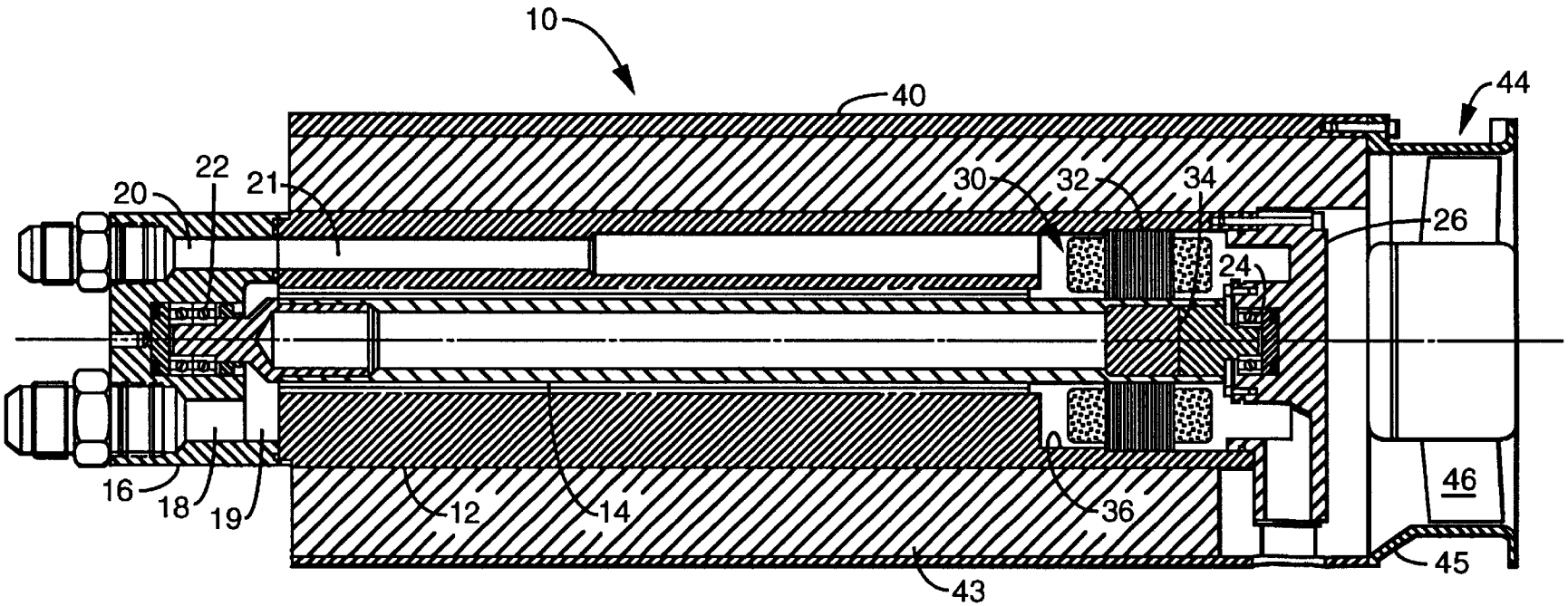
Figure 4:
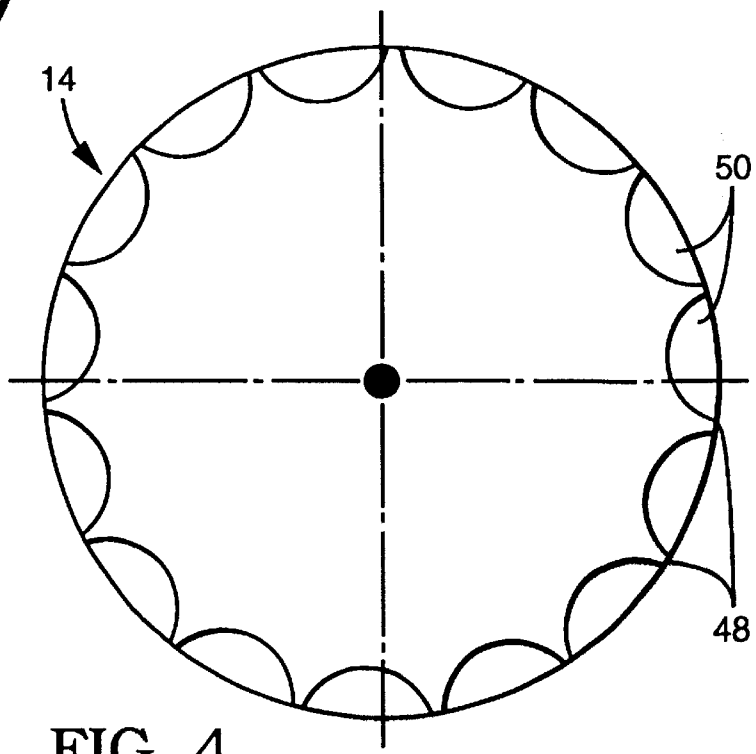
Figure 3:
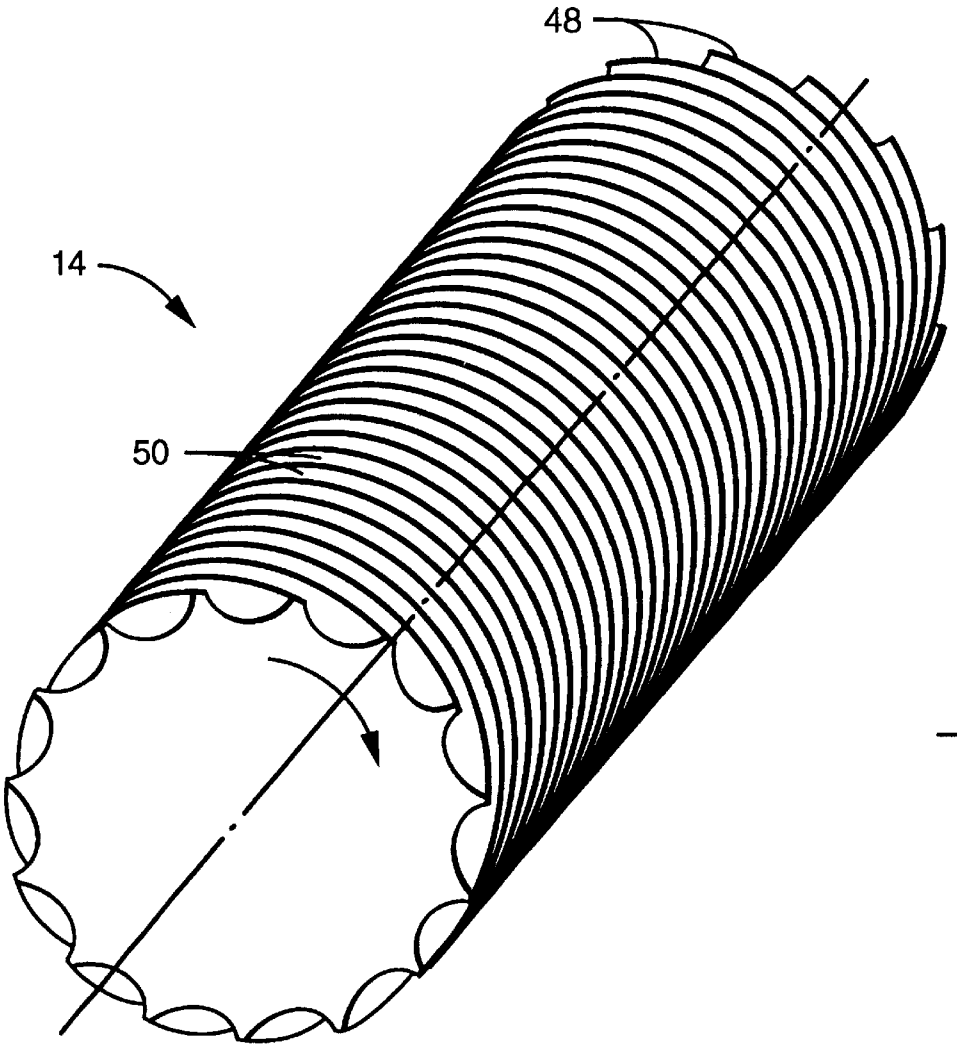
Figure 5:
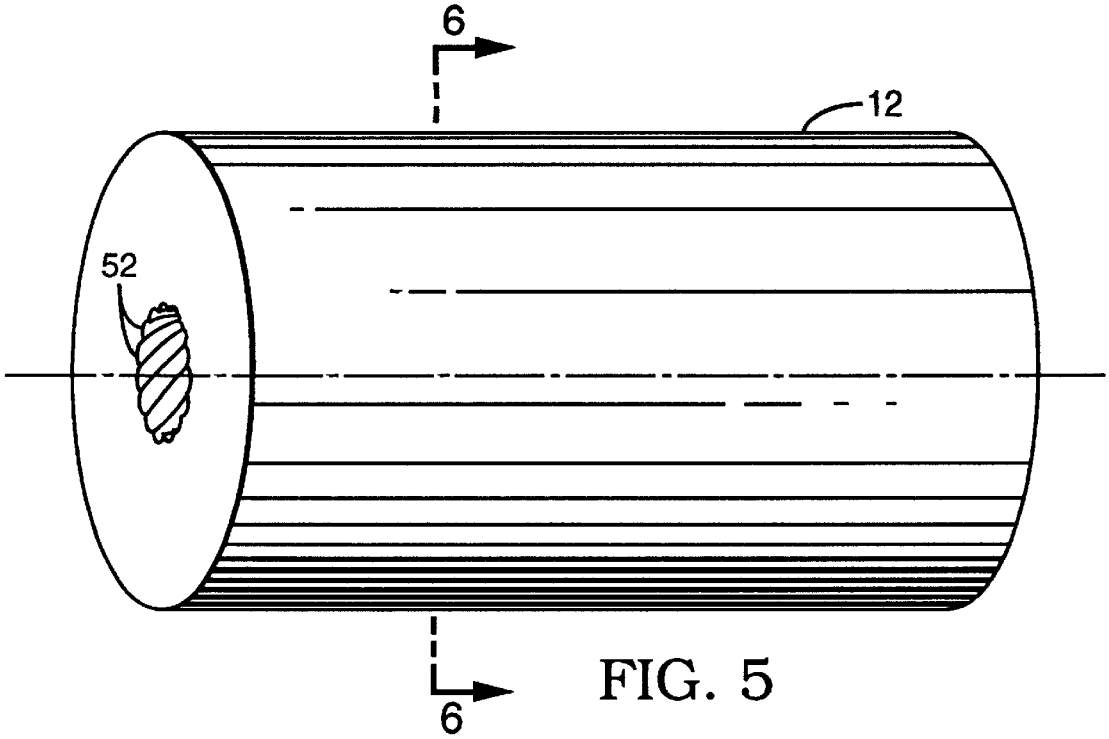
Figure 6:
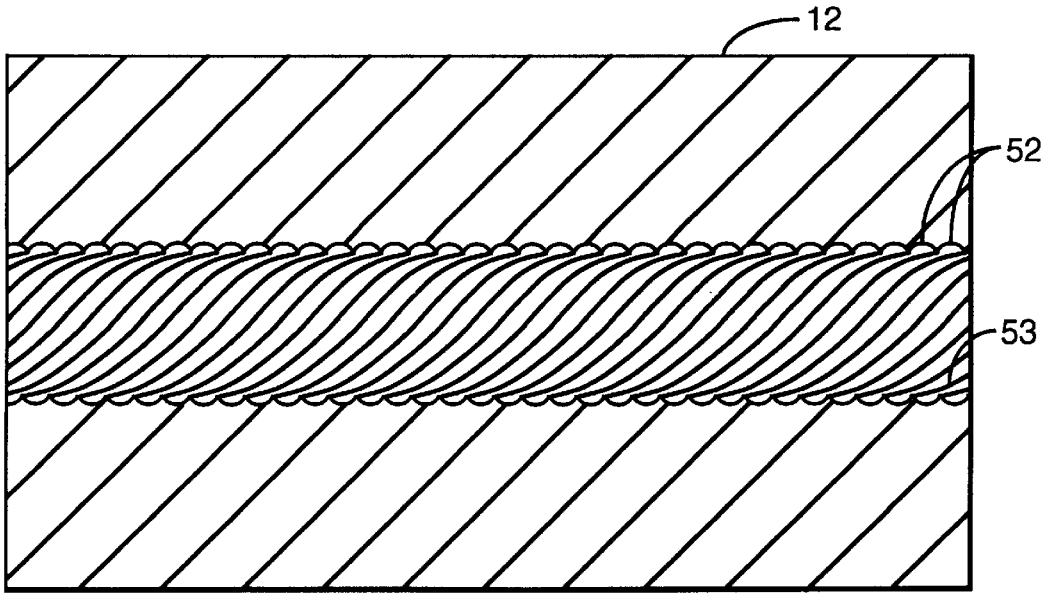
Figure 7:
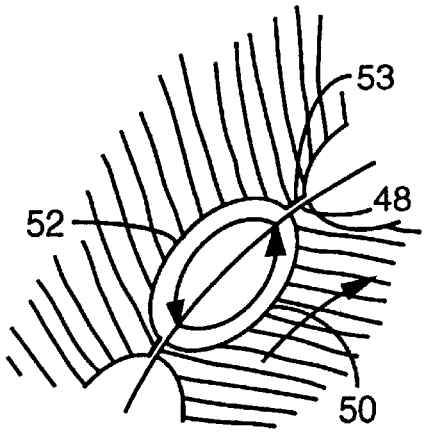
Figure 8:
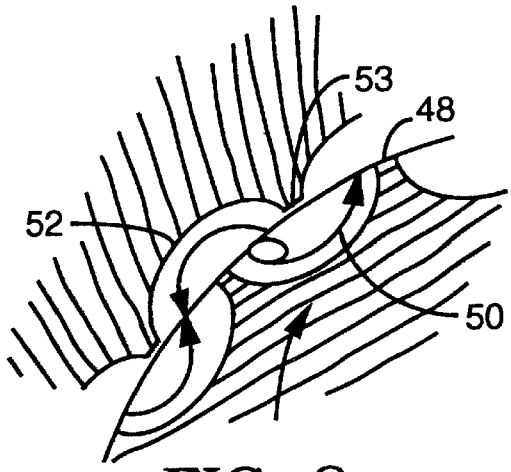
Figure 9:
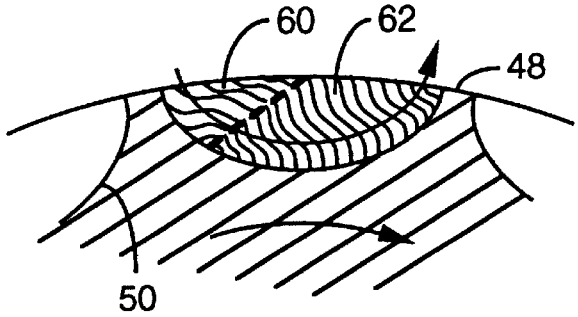
Figure 10:
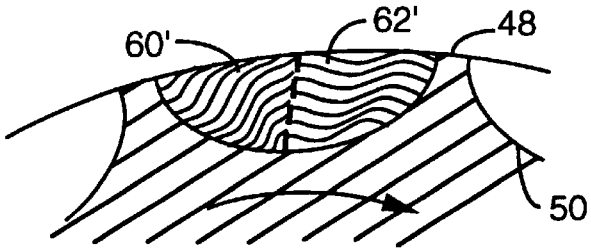
Figure 11:
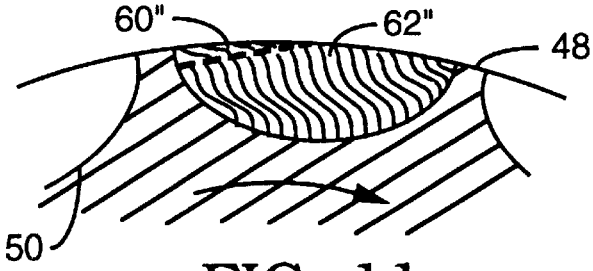
Figure 12:
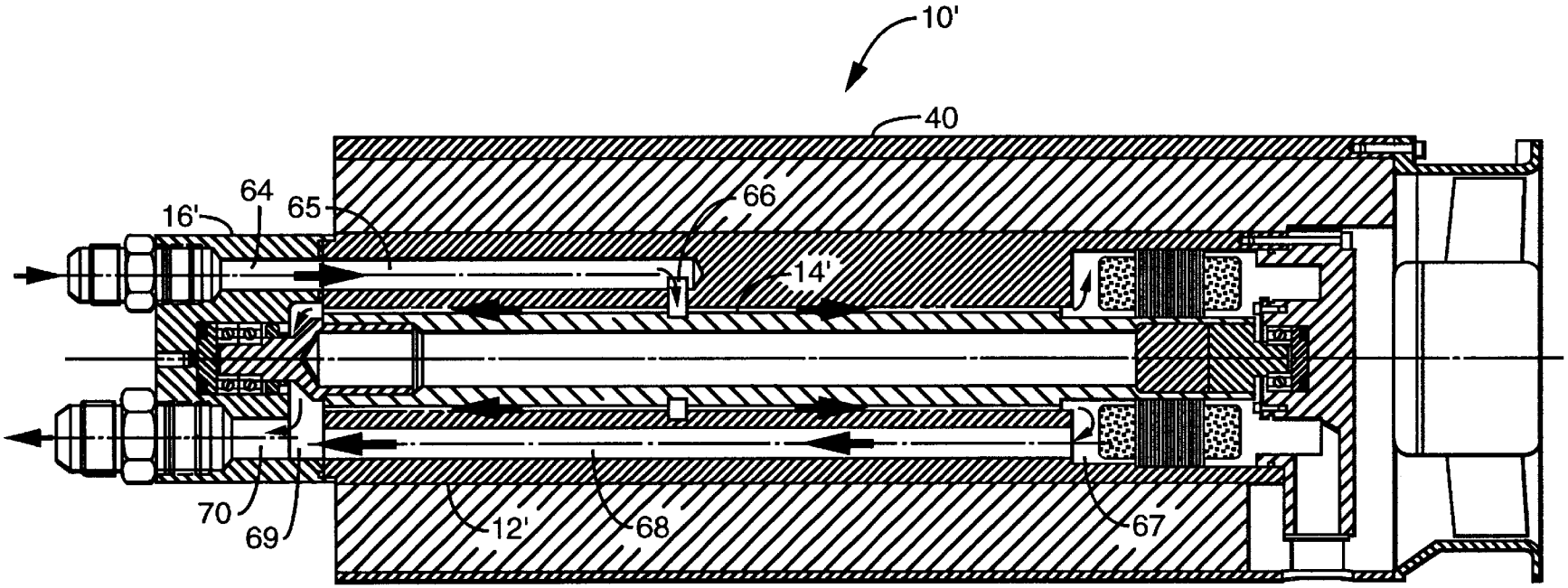
Figure 14:
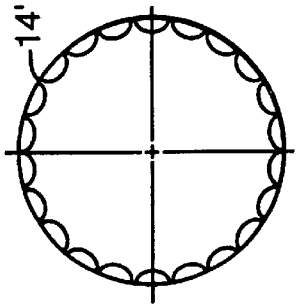
Figure 13:
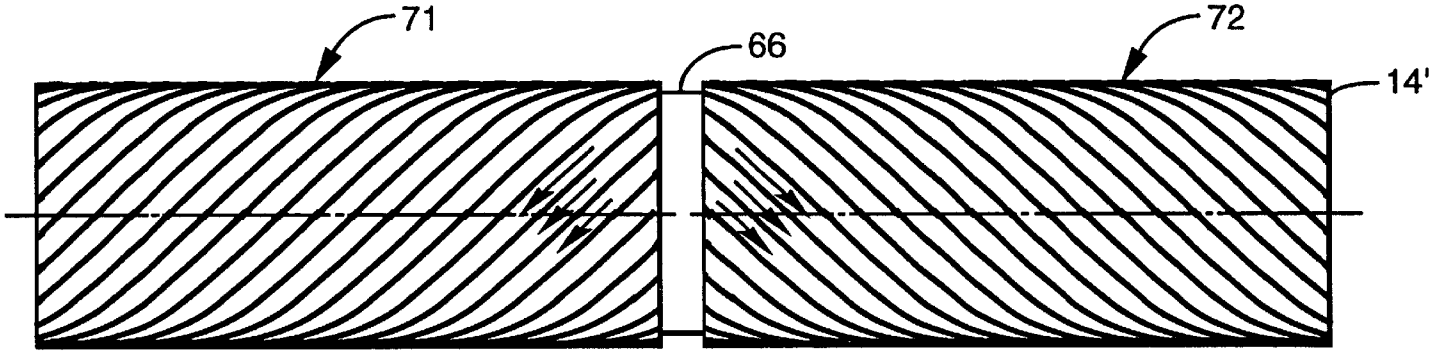
Figure 15:
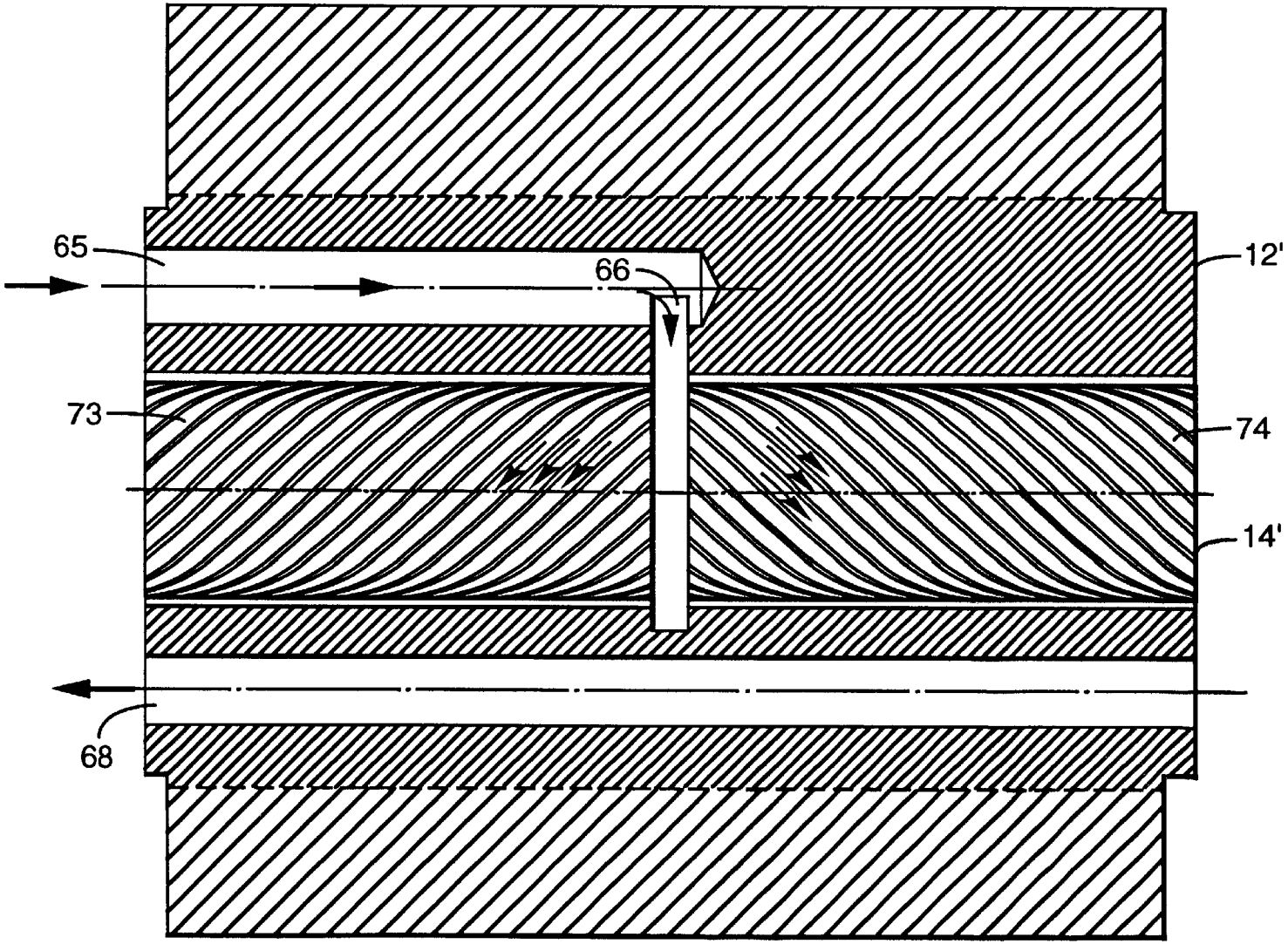
Figure 16:
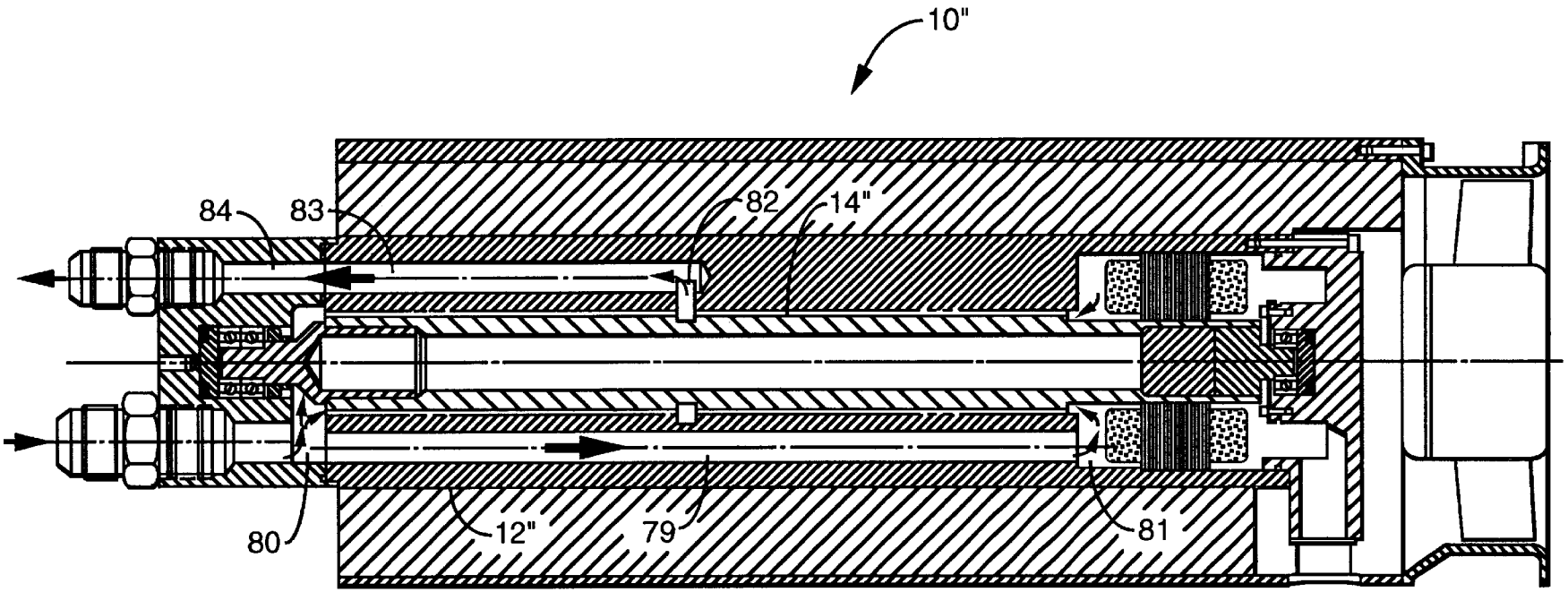
Figure 18:
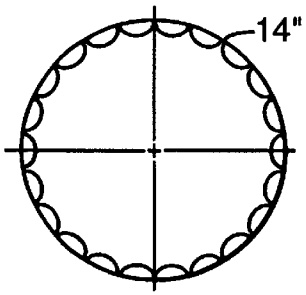
Figure 17:
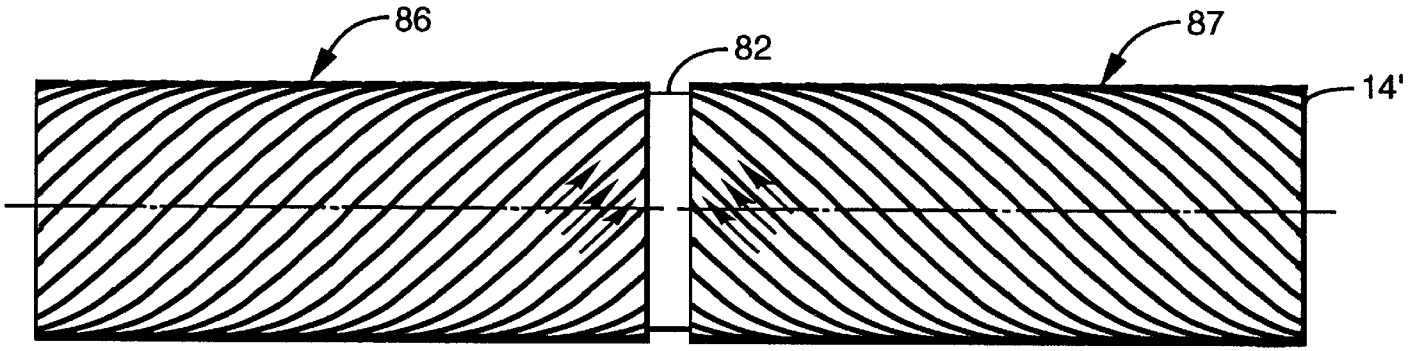
Figure 19:
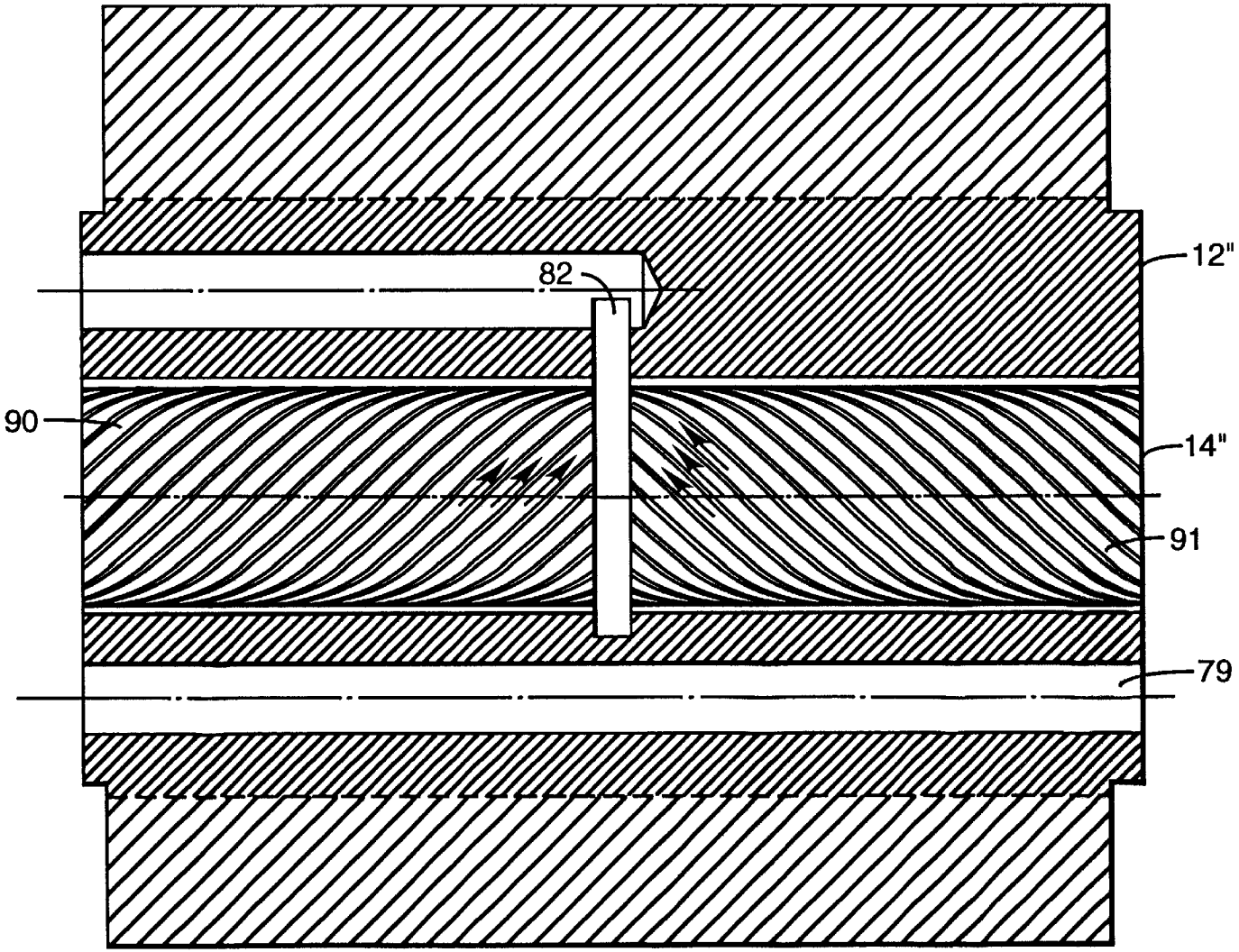
Figure 20:
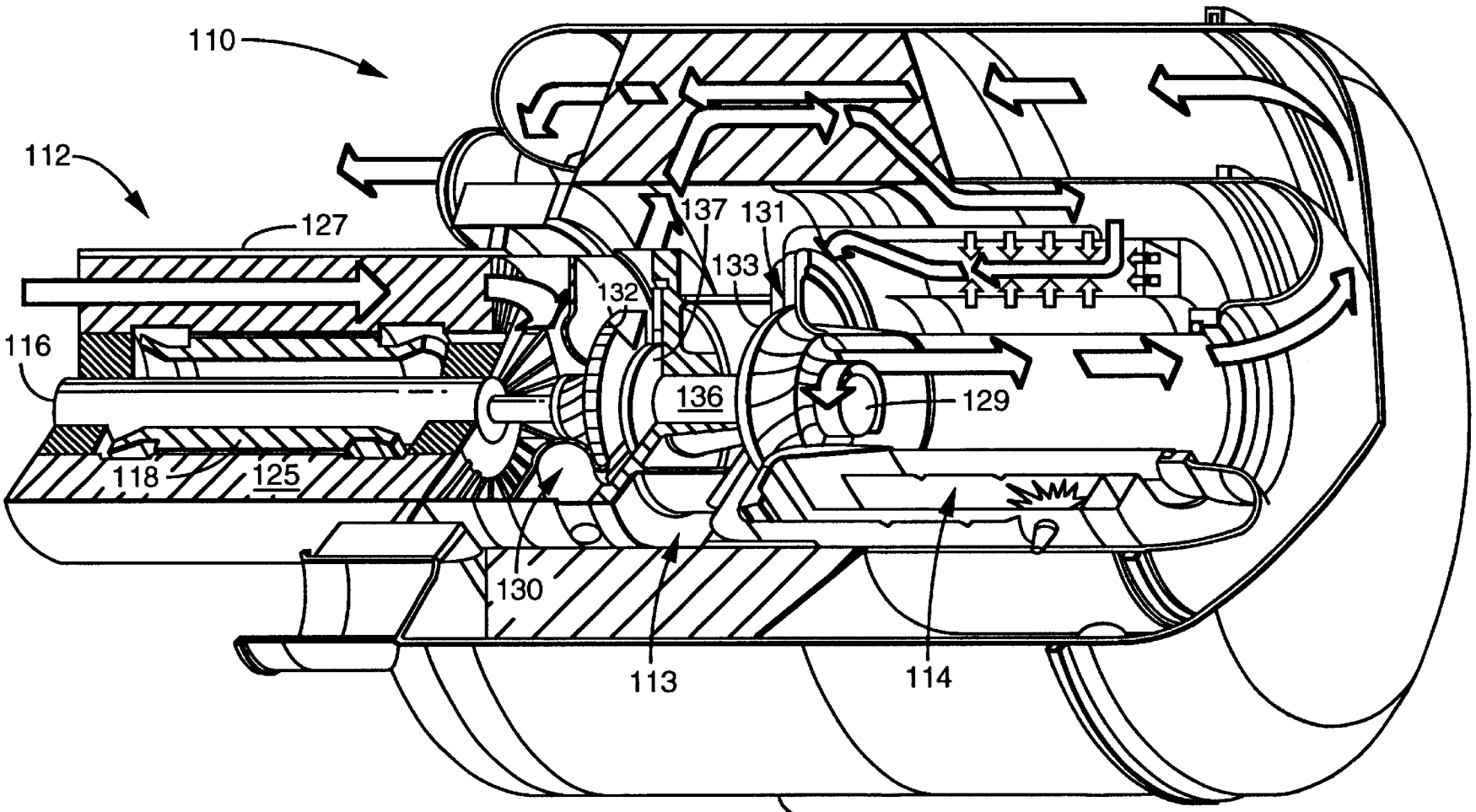
Figure 21:
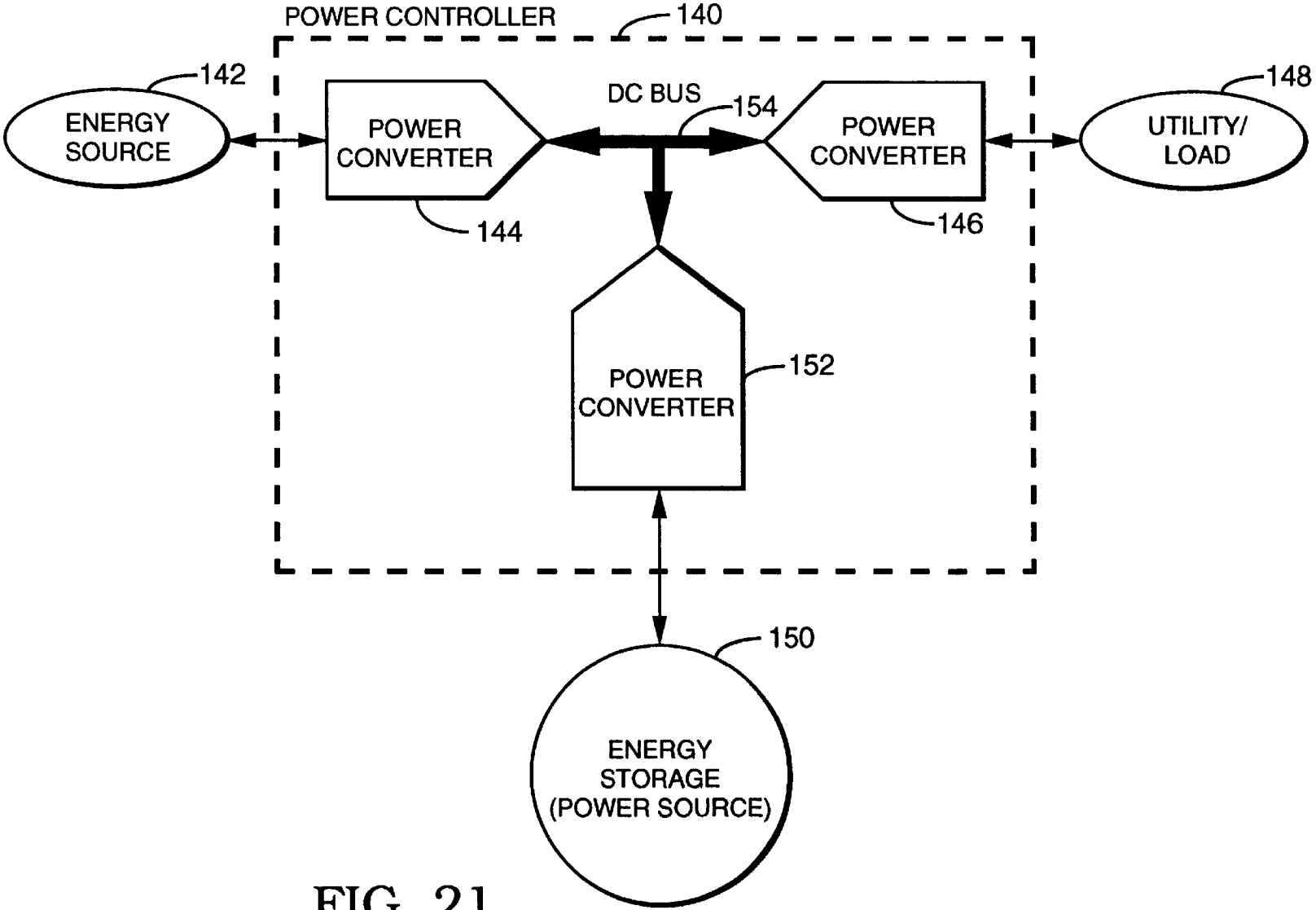
Figure 22:
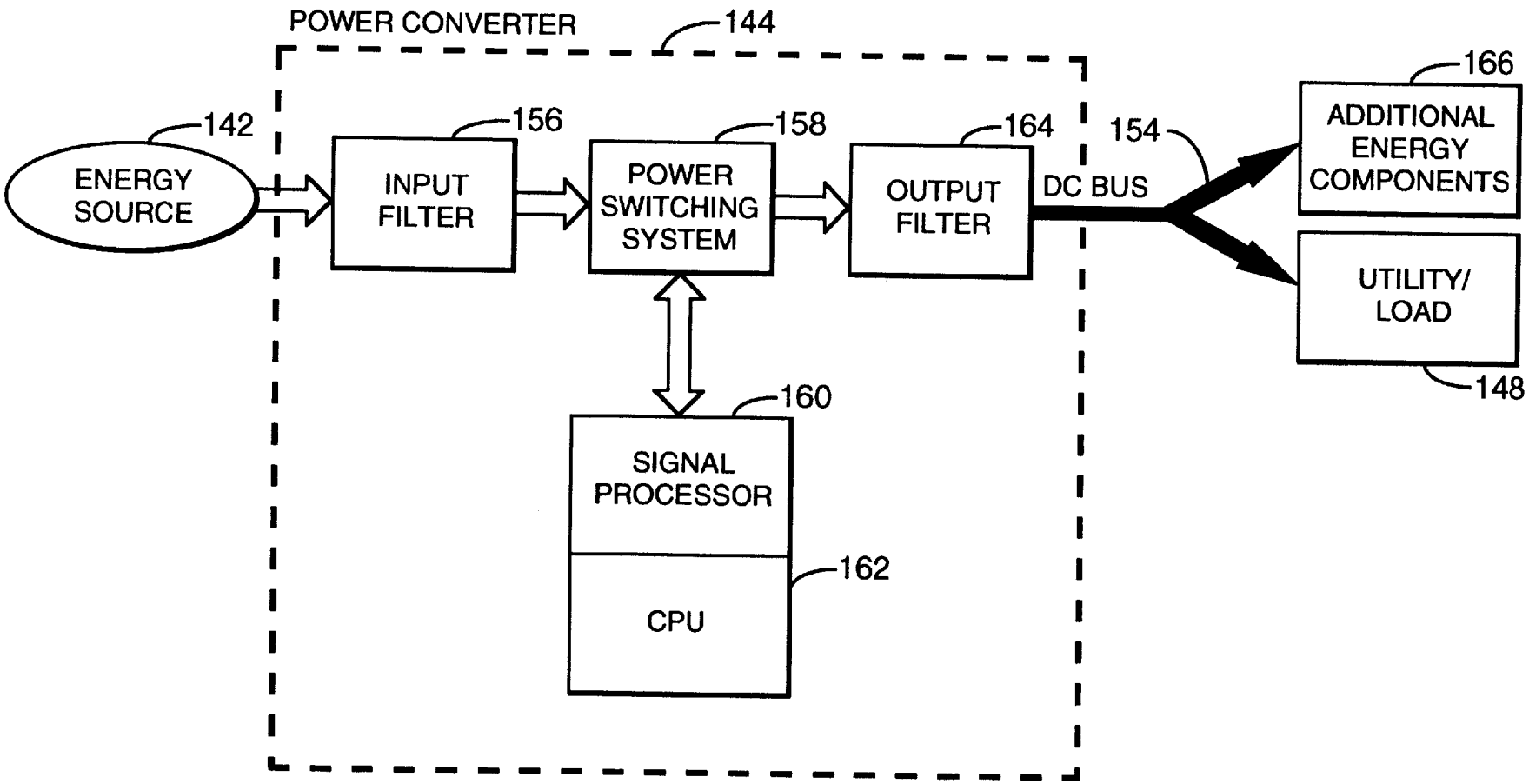
Figure 23:
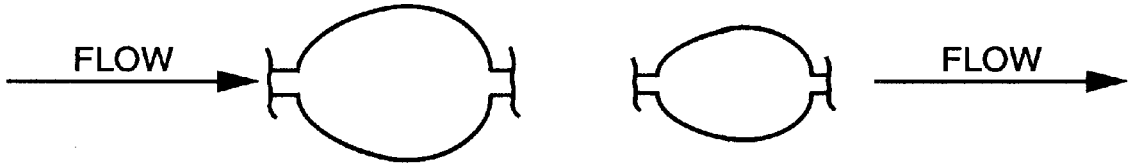
Figure 24:
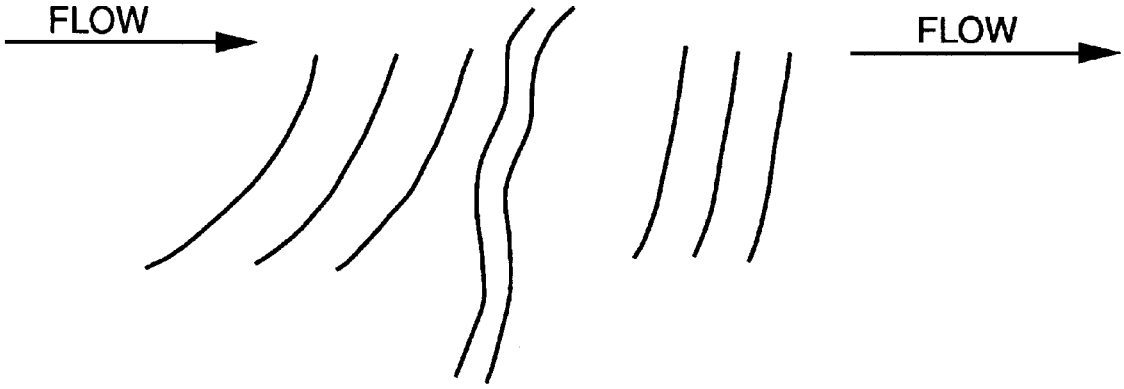
Figure 25:
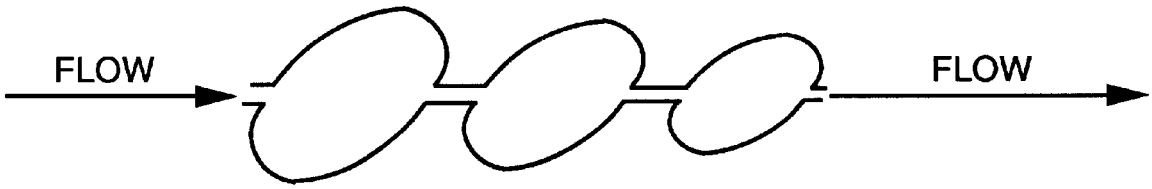

Having thus described the present invention in general terms, reference will now be made to the accompanying drawings in which:

FIG. 1 is an end view of the crossing spiral compressor/pump of the present invention;

FIG. 2 is a sectional view of the crossing spiral compressor/pump of FIG. 1 taken along line 2—2 of FIG. 1;

FIG. 3 is a perspective view of the spiral rotor of the crossing spiral compressor/pump of the FIGS. 1 and 2;

FIG. 4 is an enlarged end view of the spiral rotor of FIG. 3;

FIG. 5 is a perspective view of the stator of the crossing spiral compressor/pump of the FIGS. 1 and 2;

FIG. 6 is a cross sectional view of the stator of FIG. 5 taken along line 6—6 of FIG. 5;

FIG. 7 is an enlarged sectional view of a portion of the spiral rotor of FIGS. 3 and 4 showing an opposed aligned stator channel;

FIG. 8 is an enlarged sectional view of a portion of the spiral rotor of FIGS. 3 and 4 showing an opposed offset stator channel;

FIG. 9 is an enlarged sectional view of a portion of the spiral rotor of FIGS. 3 and 4 showing rotor channel flow at a medium back pressure;

FIG. 10 is an enlarged sectional view of a portion of the spiral rotor of FIGS. 3 and 4 showing rotor channel flow at a high back pressure;

FIG. 11 is an enlarged sectional view of a portion of the spiral rotor of FIGS. 3 and 4 showing rotor channel flow at a low back pressure;

FIG. 12 is a sectional view of an alternate crossing spiral compressor/pump of the present invention having fluid entry at the center of the compressor/pump;

FIG. 13 is a plan view of the spiral rotor of the alternate crossing spiral compressor/pump of FIG. 12;

FIG. 14 is an end view of the spiral rotor of the alternate crossing spiral compressor/pump of FIG. 12;

FIG. 15 is a sectional view of the rotor and stator of the alternate crossing spiral compressor/pump of FIG. 12;

FIG. 16 is a sectional view of an alternate crossing spiral compressor/pump of the present invention having fluid entry from both ends of the compressor/pump;

FIG. 17 is a plan view of the spiral rotor of the alternate crossing spiral compressor/pump of FIG. 16;

FIG. 18 is an end view of the spiral rotor of the alternate crossing spiral compressor/pump of FIG. 16;

FIG. 19 is a sectional view of the stator of the alternate crossing spiral compressor/pump of FIG. 16;

FIG. 20 is a perspective view, partially cut away, of a turbogenerator for use with the crossing spiral compressor/pump of the present invention;

FIG. 21 is a detailed block diagram of a power controller for the turbogenerator of FIG. 20;

FIG. 22 is a detailed block diagram of the power converter in the power controller illustrated in FIG. 21;

FIG. 23 is an enlarged sectional view of a portion of the spiral rotor and housing bore showing a change of size of the rotor fluid flow channel from one end of the rotor to the other;

FIG. 24 is an enlarged sectional view of a portion of the spiral rotor and housing bore showing a change in pitch in the rotor channel flow from the entry point to the exit point; and FIG. 25 is an enlarged sectional view of a portion of the spiral rotor and housing bore showing a change in rotor channel flow cross-sectional area from the entry point to the exit point.

DETAILED DESCRIPTION OF THE PREFERRED EMBODIMENTS

As illustrated in FIGS. 1 and 2, the crossing spiral compressor/pump 10 of the present invention generally comprises a fluid stator or stator housing 12 having a central bore within which a fluid rotor 14 is disposed to rotate. An end cap 16, having an inlet 18 and outlet 20 rotatably supports one end of the rotor 14 in duplex bearings 22 while the other end of the rotor 14 is rotatably supported by single bearing 24 held in the opposite end cap 26. The end cap inlet 18 communicates with the crossing spiral compressor/pump inlet 19 while the end cap outlet 20 communicates with the crossing spiral compressor/pump outlet 21.

The rotor 14 is driven by an electric motor 30, preferably a permanent magnet motor, having stator windings 32 disposed around a permanent magnet rotor 34, which is an extension of rotor 14. The motor 30 is in a recessed portion 36 of the fluid flow stator 12. Disposed around the stator 12 is an elongated cylindrical cooling housing 40 to form an annular passage 42 which includes a plurality of radially extending fins 43 for cooling air. A fan 44 having a plurality of blades 46 in a housing 45 attached to the cooling housing 40 forces cooling air through the annular passage 42 and fins 43 to cool the crossing spiral compressor/pump 10 and electric motor 30.

The rotor 14 is illustrated in FIGS. 3 and 4 and is generally cylindrical with a plurality of spiral blades 48, Spiral grooves or channels 50 are formed between adjacent blades 48. The pitch angle of the spiral blades 48 is generally illustrated by way of example as approximately 45 degrees.

The stator 12 is illustrated in FIGS. 5 and 6. The stator 12 is generally cylindrical with a central bore having a plurality of spiral grooves or channels 52 separated by narrow to blades 53. The stator housing bore channels 52 normally have the same pitch as the rotor channels 50 but spiral in the reverse or opposite direction.

FIGS. 7 and 8 illustrate the relationship of the rotating rotor channels 50 and the stator channels 52. FIG. 7 shows the stator housing bore channels 52 generally aligned with the rotor channels 50 wherein the fluid flow pattern normal to the rotor's rotational axis is elliptical, while FIG. 8 shows the stator housing bore channels 52 generally offset from the rotor channels 50 wherein the fluid flow pattern is more complex. FIGS. 9–11 illustrate the flow of fluid in the rotor channels 50: FIG. 9 at a medium back pressure; FIG. 10 at a high backpressure; and FIG. 11 at a low backpressure. The diffusion section 60, 60' and 60" where the fluid is decelerated, is larger with a high back pressure and smaller with a low back pressure, while the kinetic and velocity addition section 62, 62' and 62", where the fluid is accelerated, is larger at low back pressure and smaller at high back pressure.

The crossing spiral compressor/pump 10 runs at low enough speed that it can be easily run on greaseback ball bearings (or other grease lubricated rolling contact bearings) driven by a permanent magnet motor. The rotor 14 is a long cylinder and with a compression length of e.g. 10 inches and would have a rotor diameter of e.g. 1.375 inches. This produces 20 parallel flow paths in the rotor where the spiral goes one way, say clockwise, and a like spiral pattern in a stationary stator bore which goes counter-clockwise. The two spirals of the rotor channel 50 and stator channel 52 go in opposite directions.

The crossing spiral compressor/pump 10 is a type of compressor that has a single rotor 14 that allows the gas to be accelerated by the rotor 14 which puts kinetic energy into the gas and then diffuses the gas's velocity or kinetic energy into potential or pressure energy in the stator 12 and then repeats this process a fifty times or so from the time the gas enters the compressor 10 until the time it leaves. Fifty stages of compression can be achieved with a single rotor 14 with each stage of compression only having a pressure ratio of e.g. 1.03, (something that is very easy to achieve).

The gas enters the area between the rotor 14 and the stator 12 which has a small clearance, on the order of four and a half thousandths of an inch, and the gas is accelerated by the rotor blades 48 which, if rotating clockwise, will take the gas clockwise. While there will be a slight backward slippage, the gas will be driven into a rotational motion by fluid shear forces because the stator channel 52 is not rotating. This essentially causes the gas to spin and the gas in the rotor 14 goes into the stator 12 and the gas in the stator 12 is driven into the rotor 14.

Every time the gas spirals clockwise along the rotor channel 50, and crosses the flow coming from a stator channel 52 that is going counter-clockwise, the gas in the two channels 50, 52 exchanges by rotation and exchange momentum. Each time this rotation occurs the gas from the stator 12 goes into the rotor 14 and its velocity energy is diffused and converted into pressure energy in the first half of that rotor channel 50. Then in the second half of the rotor channel 50 the gas is accelerated into a local reverse flow. The gas then leaves the rotor 14 and goes into the stator 12 where it is diffused and the fluid velocity energy induced by rotor 14 is converted into pressure energy, and in the second half of the stator 12 the gas is reaccelerated in a reverse direction by a nozzle effect and is then made available for the rotor 14. This condition is particularly true at high pressure head and low flow.

Essentially, there are two quarters of rotation where diffusion is occurring, one on the rotor 14 and one on the stator 12, and two quarters of rotation where circumferential acceleration of the fluid is occurring, one on the rotor 14 and one on the stator 12. Now the gas will typically rotate 50 times between the inlet 19 and outlet 21 which gives it a hundred times to be accelerated and a hundred times to be diff-used.

The number of parallel channels that are in the rotor 14, which are spiraled in one direction, and the number of channels in the stator 12, which are spiraled in the reverse direction, can be addressed in terms of the aspect ratio of the interface between the stator channel 52 and rotor channel 50 in which the gas will be rotating. While the channels 50, 52 are shown as half circles, the gas path is actually an elliptical path so the gas is not able to spin really quickly because it's not a round path. If the grooves are made deeper into the rotor 14 and into the stator 12, (or to state it another possibly more accurate way, if the width of the grooves is made less but the depth of the grooves is kept the same) a circular cross section at the interface of the two channels (both stator and rotor) would be achieved thus easing the gas's rotation. This should produce higher pressure and higher efficiency operation. So there is a variable in the design of this kind of compressor which can be characterized as the number of parallel channels for a given depth and a given diameter of the rotor, which effectively determines the aspect ratio of the channels.

The ratio of depth to width of the channels should optimize depending upon the pitch angle of the channels which is a second variable. A third variable is the forward sloping of the blades which separate each channel and for both the stator channels and the rotor channels.

A fourth variation is the reduction in the cross sectional area of the channels as you go from the low pressure end of the compressor to the high pressure end, which is to maintain constant blade width and would also entail a tightening of the pitch angle by reducing the groove width and depth. Eventually this results in a finer pitch on the high pressure end and a coarser pitch on the low pressure end.

Now the configuration of the compressor with all these parameters might be characterized as follows: at the low pressure end (typically the inlet) of the channels there would be a coarse angle from normal to the axis of the rotor. As the spiral proceeds, the cross sectional area of the spirals will decrease towards the high-pressure end and the pitch will become finer. The blades separating the channels can be leaning forward into the direction of motion of the rotor and leaning forward towards the direction from which the rotor comes for the stator. The overall angle at the channels, both the inlet and outlet, is also a parameter and can be optimized as is the linearity of the change in the cross section area going from the low-pressure end to the high-pressure end.

While the flow of fluid in the crossing spiral compressor/pump can be in a single direction from one end of the compressor/pump to the other end as shown in FIGS. 1 and 2, the fluid can be introduced at the midpoint of the compressor/pump and discharged at both ends as illustrated in FIGS. 12–15 or can be introduced at both ends and discharged from the midpoint of the compressor/pump ad illustrated in FIGS. 16–19.

In the first bi-directional embodiment of FIGS. 12–15, the fluid enters the crossing spiral compressor/pump 10' through an inlet 64 in the end cap 16', through the inlet 65 in the stator 12' and then into the radial inlet 66 at the midpoint of the compressor pump 10'. It then proceeds in the space between the rotor 14' and stator 12' in both directions from the midpoint radial inlet 66.

The fluid travelling to the right from the radial inlet 66 is collected in radial outlet 67 and proceeds to the left in stator outlet 68. The fluid travelling to the left from the radial inlet 66 is collected in the end cap radial outlet 69 which also receives the fluid from the stator outlet 68. The combined compressed fluid exits the compressor/pump 10' through outlet 70.

As illustrated in FIGS. 13 and 14, the rotor 14' includes a first (left-end) spiral section 71 and a second (right-end) spiral section 72 on either side of central inlet 66. The first or left-end spiral section 71 spirals in one direction, shown as counterclockwise, while the second or right-end spiral section 72 spirals in the opposite direction, shown as clockwise.

The stator 12', illustrated in FIG. 15, includes a central bore having a first or left-end spiral section 73 and a second or right-end counter section 74 on either side of central inlet 66. The first or left-end spiral section 72 has a clockwise spiral while the second or right-end counter section 74 has an opposite or counterclockwise spiral. The left-end counter clockwise spiral section 71 of the rotor 14' rotates within the left-end clockwise section spiral section 73 of the stator 12' while the right-end clockwise spiral section 72 of the rotor 14' rotates within the right-end counter clockwise section spiral section 74 of the stator 12'.

In the second bi-directional embodiment of FIGS. 16–19, the fluid enters the crossing spiral compressor/pump 10" through inlets 80 and 81 at opposite ends of the rotor 14" and stator 12". The fluid then proceeds into the space between the rotor 14" and stator 12" from the left-end and through the inlet 79 in stator 12" to the right-end where this fluid proceeds in the space between the rotor 14" and stator 12". The fluid proceeds in both directions towards the midpoint radial outlet 82 and the compressed fluid is discharged through stator outlet 83 and end cap outlet 84.

As illustrated in FIGS. 17 and 18, the rotor 14" includes a first (left-end) spiral section 86 and a second (right-end) spiral section 87 on either side of central outlet 82. The first or left-end spiral section 86 spirals in one direction, shown as counterclockwise, while the second or right-end spiral section 87 spirals in the opposite direction, shown as clockwise.

The stator 12", illustrated in FIG. 19, includes a central bore having a first or left-end spiral section 90 and a second or right-end counter section 91 on either side of central radial outlet 82. The first or left-end spiral section 90 has a clockwise spiral while the second or right-end counter section 91 has on opposite or counterclockwise spiral. The left-end counter clockwise spiral section 86 of the rotor 14" rotates within the left-end clockwise section spiral bore 90 of the stator 12" while the right-end clockwise spiral section 87 of the rotor 14" rotates within the right-end counter clockwise section spiral bore 91 of the stator 12".

With the fluid flow entering at the mid point of the rotor and stator housing bore fluid flow channels and exiting at both ends of the fluid flow channels (or alternately, enters at both ends and exits at the mid point of the rotor and stator housing bore), the bi-directional fluid flow path results in the possibility of generating no fluid generated thrust load on the rotor bearings. This also permits the utilization of a larger diameter for the rotor that allows the length of the rotor to be reduced.

One possible use for the crossing spiral compressor/pump 10 is to compress natural gas or other gaseous fuel for a machine such as a turbogenerator. The crossing spiral compressor/pump 10 can take natural gas that is essentially at atmospheric pressure and can boost the natural gas to a pressure over 30 pounds per square inch (PSI) gauge. All of this can be accomplished with a compressor that does not have rubbing surfaces, does not have oil lubrication, and does not have seals that can wear. To do this with a centrifugal compressor would require very high tip speed, large diameters and high rpms, and would have inherently large leakages from the impeller blades to the scroll.

A permanent magnet turbogenerator 110 is illustrated in FIG. 20 as an example of a turbogenerator for use with the crossing spiral compressor/pump of the present invention. The permanent magnet turbogenerator 110 generally comprises a permanent magnet generator 112, a power head 113, a combustor 114 and a recuperator (or heat exchanger) 115.

The permanent magnet generator 112 includes a permanent magnet rotor or sleeve 116, having a permanent magnet disposed therein, rotatably supported within stator 118 by a pair of spaced journal bearings. Radial stator cooling fins 125 are enclosed in an outer cylindrical sleeve 127 to form an annular air flow passage which cools the stator 118 and thereby preheats the air passing through on its way to the power head 113.

The power head 113 of the permanent magnet turbogenerator 110 includes compressor 130, turbine 131, and bearing rotor 136 through which the tie rod 129 passes. The compressor 130, having compressor impeller or wheel 132 which receives preheated air from the annular air flow passage in cylindrical sleeve 127 around the permanent magnet motor stator 118, is driven by the turbine 131 having turbine wheel 133 which receives heated exhaust gases from the combustor 114 supplied with air from recuperator 115. The compressor wheel 132 and turbine wheel 133 are rotatably supported by bearing shaft or rotor 136 having radially extending bearing rotor thrust disk 137.

The bearing rotor 136 is rotatably supported by a single journal bearing within the center bearing housing while the bearing rotor thrust disk 137 at the compressor end of the bearing rotor 136 is rotatably supported by a bilateral thrust bearing. The bearing rotor thrust disk 137 is adjacent to the thrust face of the compressor end of the center bearing housing while a bearing thrust plate is disposed on the opposite side of the bearing rotor thrust disk 137 relative to the center housing thrust face.

Intake air is drawn through the permanent magnet generator 112 by the compressor 130 that increases the pressure of the air and forces it into the recuperator 115. In the recuperator 115, exhaust heat from the turbine 131 is used to preheat the air before it enters the combustor 114 where the preheated air is mixed with fuel and burned. The combustion gases are then expanded in the turbine 131 which drives the compressor 130 and the permanent magnet rotor 116 of the permanent magnet generator 112 which is mounted on the same shaft as the turbine wheel 133. The expanded turbine exhaust gases are then passed through the recuperator 115 before being discharged from the turbogenerator 110.

The system has a steady-state turbine exhaust temperature limit, and the turbogenerator operates at this limit at most speed conditions to maximize system efficiency. This turbine exhaust temperature limit is decreased at low ambient temperatures to prevent engine surge.

Referring to FIG. 21, the power controller 140, which may be digital, provides a distributed generation power networking system in which bidirectional (i.e. reconfigurable) power converters (or inverters) are used with a common DC bus 154 for permitting compatibility between one or more energy components. Each power converter operates essentially as a customized bidirectional switching converter configured, under the control of power controller 140, to provide an interface for a specific energy component to DC bus 154. Power controller 140 controls the way in which each energy component, at any moment, with sink or source power, and the manner in which DC bus 154 is regulated. In this way, various energy components can be used to supply, store and/or use power in an efficient manner. The energy components, as shown in FIG. 21, include an energy source 142 such as the turbogenerator 110, utility/load 148, and storage device 150, which can simply be a battery.

A detailed block diagram of power converter 144 in the power controller 140 of FIG. 21 is illustrated in FIG. 22. The energy source 142 is connected to DC bus 154 via power converter 144. Energy source 142 may produce AC that is applied to power converter 144. DC bus 154 connects power converter 144 to utility/load 148 and additional energy components 166. Power converter 144 includes input filter 156, power switching system 158, output filter 164, signal processor 160 and main CPU 162.

In operation, energy source 142 applies AC to input filter 156 in power converter 144. The filtered AC is then applied to power switching system 158 which may conveniently be a series of insulated gate bipolar transistor (IGBT) switches operating under the control of signal processor 160 which is controlled by main CPU 162. The output of the power switching system 158 is applied to output filter 164 which then applies the filtered DC to DC bus 154.

Each power converter 144, 146, and 152 operates essentially as a customized, bi-directional switching converter under the control of main CPU 162, which uses signal processor 160 to perform its operations. Main CPU 162 provides both local control and sufficient intelligence to form a distributed processing system. Each power converter 144, 146, and 152 is tailored to provide an interface for a specific energy component to DC bus 154. Main CPU 162 controls the way in which each energy component 142, 148, and 150 sinks or sources power and DC bus 154 is regulated at any time. In particular, main CPU 162 reconfigures the power converters 144, 146, and 152 into different configurations for different modes of operation. In this way, various energy components 142, 148, and 150 can be used to supply, store and/or use power in an efficient manner.

In the case of a turbogenerator 110 as the energy source 142, a conventional system regulates turbine speed to control the output or bus voltage. In the power controller 140, the bi-directional controller functions independently of turbine speed to regulate the bus voltage.

FIGS. 21 and 22 generally illustrate the system topography with the DC bus 154 at the center of a star pattern network. In general, energy source 142 provides power to DC bus via power converter 144 during normal power generation mode. Similarly, during power generation, power converter 146 converts the power on DC bus 154 to the form required by utility/load 148. During utility start up, power converters 144 and 146 are controlled by the main processor to operate in different manners. For example, if energy is needed to start the turbogenerator 110, this energy may come from load/utility 148 (utility start) or from energy source 150 (non-utility start). During a utility start up, power converter 146 is required to apply power from load 148 to DC bus for conversion by power converter 144 into the power required by the turbogenerator 110 to start up. During utility start, the turbogenerator 110 is controlled in a local feedback loop to maintain the turbine revolutions per minute (RPM). Energy storage 150 is disconnected from DC bus while loadlutility grid regulates $V_{DC}$ on DC bus 154.

Similarly, in a non-utility start, the power applied to DC bus 154 from which turbogenerator 110 may be started, may be provided by energy storage 150. Energy storage 150 has its own power conversion circuit in power converter 152, which limits the surge current into the DC bus 154 capacitors, and allows enough power to flow to DC bus 154 to start turbogenerator 110. In particular, power converter 156 isolates the DC bus 154 so that power converter 144 can provide the required starting power from DC bus 154 to turbogenerator 110.

A more detailed description of the power controller can be found in U.S. patent application Ser. No. 207,817, filed Dec. 8, 1998 by Mark G. Gilbreth et al, entitled "Power Controller", assigned to the same assignee as this application and hereby incorporated by reference.

FIGS. 23, 24, and 25 illustrate alternative channel arrangements where the size of the channels varies from entry point to exit point (FIG. 23), the pitch of the channels varies from entry point to exit point (FIG. 24), and the channel fluid flow entry point blade shape varies (FIG. 25).

While specific embodiments of the invention have been illustrated and described, it is to be understood that these are provided by way of example only and that the invention is not to be construed as being limited thereto but only by the proper scope of the following claims.

What is claimed is:

1. A rotary machine comprising:

a stator housing having a central bore with a plurality of fluid flow channels spiraling in a first direction; and a rotor rotatably supported within said central bore of said stator housing, said rotor with a plurality of fluid flow channels on its outer surface spiraling in a second direction opposite to said first direction;

said plurality of stator housing bore fluid flow channels separated by blades which are significantly narrower than the width of said stator housing bore fluid flow channels and said plurality of rotor fluid flow channels separated by blades which are significantly narrower than the width of said rotor fluid flow channels.

2. The rotary machine of claim 1, and in addition, means to introduce fluid to said plurality of stator housing bore fluid flow channels and said plurality of rotor fluid flow channels at one end thereof and to collect fluid at the other end thereof.

3. The rotary machine of claim 2 wherein in the single direction of fluid flow the fluid generated thrust load on the rotor bearings is equal to pi times the square of the rotor radius times the differential fluid pressure across the rotary machine.

4. The rotary machine of claim 1, and in addition, means to introduce fluid to said plurality of stator housing bore fluid flow channels and said plurality of rotor fluid flow channels generally at the midpoint of said rotor and said stator housing, with generally one half of the introduced fluid travelling in one axial direction away from said midpoint and the other half of the introduced fluid travelling away from said midpoint in the opposite axial direction, and means disposed at each end of said stator housing and said rotor to collect fluid from said plurality of stator housing bore fluid flow channels and said plurality of rotor fluid flow channels.

5. The rotary machine of claim 4 wherein the bidirectional fluid flow path results in generating minimal to no fluid generated thrust load on the rotor bearings.

6. The rotary machine of claim 1, and in addition, means to introduce fluid to said plurality of stator housing bore fluid flow channels and said plurality of rotor fluid flow channels generally at each end of said rotor and said stator housing, and means generally at the midpoint of said stator housing and said rotor to collect the introduced fluid from said plurality of stator housing bore fluid flow channels and said plurality of rotor fluid flow channels.

7. The rotary machine of claim 6 wherein the bidirectional fluid flow path results in generating minimal to no fluid generated thrust load on the rotor bearings.

8. The rotary machine of claim 1, and in addition, means to rotate said rotor with respect to said stator housing to compress or pressurize the fluid in said plurality of rotor fluid flow channels and said plurality of stator housing bore fluid flow channels.

9. The rotary machine of claim 1 wherein said fluid is expanded or depressurized within said plurality of rotor fluid flow channels and said plurality of stator housing bore fluid flow channels to impart rotation to said rotor with respect to said stator housing.

10. The rotary machine of claim 1 wherein each of said plurality of spiraling fluid flow channels on said rotor crosses many of said plurality of spiraling fluid flow channels in the central bore of said stator housing.

11. The rotary machine of claim 1 wherein each of said plurality of spiraling fluid flow channels in the central bore of said stator housing crosses many of said plurality of spiraling fluid flow channels on said rotor.

12. The rotary machine of claim 1 wherein each of said plurality of spiraling fluid flow channels on said rotor crosses many of said plurality of spiraling fluid flow channels in the central bore of said stator housing, and each of said plurality of spiraling fluid flow channels in the central bore of said stator housing crosses many of said plurality of spiraling fluid flow channels on said rotor.

13. The rotary machine of claim 12 wherein the crossing intersections of said plurality of rotor fluid flow channels with said plurality of stator housing bore fluid flow channels combine to form a plurality of elliptical fluid flow channels normal to the rotational axis of said rotor.

14. The rotary machine of claim 13 wherein the spiral flow patterns of the fluid in said plurality of rotor fluid flow channels, the spiral flow pattern of the fluid in said plurality of stator housing bore fluid flow channels, and the spiral flow pattern of the fluid in said plurality of elliptical combined fluid flow channels where the rotor and the stator housing fluid flow channels cross, will cause the fluid passing through the rotary machine to alternately pass through the rotor fluid flow channels and through the stator housing bore fluid flow channels and then repeat this sequence several more times before exiting the rotary machine.

15. The rotary machine of claim 12 wherein the rotation of said rotor within said stator housing bore and the crossing intersections of said plurality of rotor fluid flow channels in said stator housing bore induce fluid flow along the axis of said rotor's rotation within the annulus formed between said rotor and said stator housing bore.

16. The rotary machine of claim 12 wherein the rotation of said rotor within said stator housing bore and the crossing intersections of said plurality of rotor fluid flow channels in the stator housing bore induce a pressure rise in the fluid as the fluid moves through the rotary machine.

17. The rotary machine of claim 12 wherein the fluid in said plurality of rotor fluid flow channels leaves the rotor fluid flow channels and enters said plurality of stator housing bore fluid flow channels at the crossing intersections of said plurality of rotor fluid flow channels and said plurality of stator housing bore fluid flow channels.

18. The rotary machine of claim 12 wherein the fluid in said plurality of stator housing bore fluid flow channels leaves the stator housing bore fluid flow channels and enters said plurality of rotor fluid flow channels at the crossing intersections of said plurality of stator housing bore fluid flow channels and said plurality of rotor fluid flow channels.

19. The rotary machine of claim 12 wherein the fluid in said plurality of rotor fluid flow channels leaves the rotor fluid flow channels and enters said plurality of stator housing bore fluid flow channels at the crossing intersections of said plurality of rotor fluid flow channels and said plurality of stator housing bore fluid flow channels, and the fluid in said plurality of stator housing bore fluid flow channels leaves the stator housing bore fluid flow channels and enters said plurality of rotor fluid flow channels at the crossing intersections of said plurality of stator housing bore fluid flow channels and said plurality of rotor fluid flow channels.

20. The rotary machine of claim 19 wherein the fluid leaving said plurality of rotor fluid flow channels and entering said plurality of stator housing bore fluid flow channels at the crossing intersections of said plurality of rotor fluid flow channels and said plurality of stator housing bore fluid flow channels, and the fluid leaving said plurality of stator housing bore fluid flow channels and entering said plurality of rotor fluid flow channels at the crossing intersections of said plurality of stator housing bore fluid flow channels and said plurality of rotor fluid flow channels, will have a combined flow pattern whose component normal to said rotor's rotation axis is essentially a spinning motion that follows the elliptical shape of the combined fluid flow channel.

21. The rotary machine of claim 1 wherein each of said plurality of rotor fluid flow channels has a cross section normal to the spiral axis of that channel that resembles a half circle with the opening facing the central bore of said stator housing.

22. The rotary machine of claim 1 wherein each of said plurality of stator housing bore fluid flow channels has a cross section normal to the spiral axis of that channel that resembles a half circle with the opening facing said rotor.

23. The rotary machine of claim 1 wherein each of said plurality of rotor fluid flow channels has a cross section normal to the spiral axis of that channel that resembles a half circle with the opening facing the central bore of said stator housing, and each of said plurality of stator housing bore fluid flow channels has a cross section normal to the spiral axis of that channel that resembles a half circle with the opening facing said rotor.

24. The rotary machine of claim 1, when used as a compressor or gas turbine, wherein the cross sectional area of said plurality of rotor fluid flow channels decreases from the low pressure end to the high pressure end of the rotary machine to compensate for increasing fluid density.

25. The rotary machine of claim 1, when used as a compressor or gas turbine, wherein the cross sectional area of said plurality of stator housing bore fluid flow channels decreases from the low pressure end to the high pressure end of the rotary machine to compensate for increasing fluid density.

26. The rotary machine of claim 1 wherein the cross sectional area of said plurality of rotor fluid flow channels and the cross sectional area of said plurality of stator housing bore fluid flow channels each decreases from the low pressure end to the high pressure end of the rotary machine to compensate for increasing fluid density.

27. The rotary machine of claim 1 wherein the rotor fluid flow channel blades separating each rotor fluid flow channel from the adjacent rotor fluid flow channels do not, by virtue of their width, form seals that resist fluid flow from one rotor fluid flow channel to either of the adjacent rotor fluid flow channels.

28. The rotary machine of claim 1 wherein the stator housing bore fluid flow channel blades separating each stator housing bore fluid flow channel from the adjacent stator housing bore fluid flow channels do not, by virtue of their width, form seals that resist fluid flow from one stator housing bore fluid flow channel to either of the adjacent stator housing bore fluid flow channels.

29. The rotary machine of claim 1 wherein the rotor fluid flow channel blades separating each rotor fluid flow channel from the adjacent rotor fluid flow channels do not, by virtue of their width, form seals that resist fluid flow from one rotor fluid flow channel to either of the adjacent rotor fluid flow channels, and the stator housing bore fluid flow channel blades separating each stator housing bore fluid flow channel from the adjacent stator housing bore fluid flow channels do not, by virtue of their width, form seals that resist fluid flow from one stator housing bore fluid flow channel to either of the adjacent stator housing bore fluid flow channels.

30. The rotary machine of claim 1 wherein the rotation of said rotor within said stator housing bore induces the fluid in said plurality of stator housing bore fluid flow channels to spin about the stator housing bore fluid flow channel's spiral axis.

31. The rotary machine of claim 1 wherein the rotation of said rotor within said stator housing bore induces the fluid in said plurality of rotor fluid flow channels to spin about the rotor fluid flow channel's spiral axis.

32. The rotary machine of claim 1 wherein said plurality of rotor fluid flow channels convert rotor shaft power into fluid kinetic or velocity energy.

33. The rotary machine of claim 1 wherein the high velocity fluid leaving said plurality of rotor fluid flow channels and entering said plurality of stator housing bore fluid flow channels will have much of its kinetic or velocity energy converted into potential or pressure energy by the stationary stator housing bore fluid flow channels acting as vaneless diffusers.

34. The rotary machine of claim 1 wherein the fluid passes many times alternately through the rotor fluid flow channels and stator housing bore fluid flow channels as the fluid passes through the rotary machine.

35. The rotary machine of claim 1 wherein the fluid passing through the rotary machine will experience an increase in kinetic or velocity energy each time the fluid passes through said plurality of rotor fluid flow channels.

36. The rotary machine of claim 1 wherein the fluid passing through the rotary machine will experience a conversion of kinetic or velocity energy into potential or pressure energy each time the fluid passes through the stator housing bore fluid flow channels.

37. The rotary machine of claim 1 wherein said rotor is rotatably supported within said stator housing bore by grease packed ball bearings.

38. The rotary machine of claim 1 wherein, when operating at its highest flow and lowest pressure rise capability, the spiral flow patterns of the fluid flowing through the rotary machine will have a loose pitch with a minimum of flow passes through said plurality of rotor fluid flow channels.

39. The rotary machine of claim 1 wherein, when operating at its highest flow and lowest pressure rise capability, the fluid flow passing through said plurality of rotor fluid flow channels increases its kinetic or velocity energy during substantially the entire period of passage of the fluid through said plurality of rotor fluid flow channels.

40. The rotary machine of claim 1 wherein, when operating at its highest flow and lowest pressure rise capability, the fluid flow passing through said plurality of stator housing bore fluid flow channels converts its kinetic or velocity energy into potential or pressure energy during substantially the entire period of passage of the fluid through said plurality of stator housing bore fluid flow channels.

41. The rotary machine of claim 1 wherein, when operating at its lowest flow and highest pressure rise capability, the spiral flow patterns of the fluid flowing through the rotary machine will have a tight pitch with a maximum of fluid flow passes through said plurality of rotor fluid flow channels.

42. The rotary machine of claim 1 wherein, when operating at its lowest flow and highest pressure rise capability, the fluid flow passing through said plurality of rotor fluid flow channels increases its kinetic or velocity energy only during the later part of its passage through said plurality of rotor fluid flow channels.

43. The rotary machine of claim 1 wherein, when operating at its lowest flow and highest pressure rise capability, said plurality of rotor fluid flow channels behave as rotating diffusers during the early part of fluid flow passage through said plurality of rotor fluid flow channels.

44. The rotary machine of claim 1 wherein, when operating at its lowest flow and highest pressure rise capability, the fluid flow passing through said plurality of stator housing bore fluid flow channels will experience conversion of its kinetic or velocity energy into potential or pressure energy only during the earliest part of its passage through said plurality of stator housing bore channels.

45. The rotary machine of claim 1 wherein, when operating at its lowest flow and highest pressure rise capability, said plurality of stator housing bore fluid flow channels behave as nozzles, converting the fluid's potential or pressure energy into kinetic or velocity energy and producing a local flow with an axial component opposed to the general fluid flow through the rotary machine.

46. The rotary machine of claim 1 wherein the blades at the radial flow entry point of said plurality of rotor fluid flow channels have a radial slope.

47. The rotary machine of claim 1 wherein the blades at the radial flow entry point of said plurality of rotor fluid flow channels have a forward leaning slope.

48. The rotary machine of claim 1 wherein the blades at the radial flow entry point of said plurality of stator housing bore fluid flow channels have a forward leaning slope.

49. The rotary machine of claim 1 wherein the blades at the radial flow entry point of said plurality of stator housing bore fluid flow channels have a radial slope.

50. The rotary machine of claim 1 wherein the blades at the radial flow entry point of said plurality of rotor fluid flow channels have a radial slope and the blades at the radial flow entry point of said plurality of stator housing bore fluid flow channels have a radial slope.

51. The rotary machine of claim 1 wherein the blades at the radial flow entry point of said plurality of rotor fluid flow channels have a forward leaning slope and the blades at the radial flow entry point of said plurality of stator housing bore fluid flow channels have a forward leaning slope.

52. The rotary machine of claim 1 wherein the pitch of said plurality of rotor fluid flow channels spiral varies from one end of the rotor to the other end.

53. The rotary machine of claim 52 wherein the pitch of said plurality of rotor fluid flow channels spiral varies from one end of the rotor to the other end with a tighter pitch and a reduced channel cross-sectional area at the high pressure end.

54. The rotary machine of claim 1 wherein the cross-sectional area of said plurality of rotor fluid flow channels is reduced as the fluid flow approaches the fluid exit.

55. The rotary machine of claim 1 wherein the cross-sectional area of said plurality of stator housing bore fluid flow channels is reduced as the fluid flow approaches the fluid exit.

56. The rotary machine of claim 1 wherein the cross-sectional area of said plurality of rotor fluid flow channels is reduced as the fluid flow approaches the fluid exit and the cross-sectional area of said plurality of stator housing bore fluid flow channels is reduced as the fluid flow approaches the fluid exit.

57. The rotary machine of claim 1 wherein the pitch of said plurality of stator housing bore fluid flow channels spiral varies from one end of the rotor to the other end.

58. The rotary machine of claim 57 wherein the pitch of said plurality of stator housing bore fluid flow channels spiral varies from one end of the stator housing to the other end with a tighter pitch and a reduced channel cross-sectional area at the high pressure end.

59. A rotary machine including a crossing spiral compressor/pump/turbine and a permanent magnet motor/generator comprising:

a housing including a motor/generator stator positioned at one end of said housing and a compressor/turbine stator at the other end of said housing;

a shaft rotatably supported within said housing;

a permanent magnet rotor disposed on said shaft at one end thereof and rotatably supported within said motor/generator stator;

a compressor/pump/turbine disposed at the other end of said shaft and rotatably supported within said compressor/turbine stator;

said compressor/pump/turbine rotor having a plurality of fluid flow channels spiraling in a first direction and said compressor/turbine stator having a plurality of fluid flow channels operably associated with said plurality of spiraling rotor fluid flow channels and spiraling in a second direction opposite to said first direction.

60. The rotary machine of claim 59 wherein said shaft is rotatably supported within said housing at one end by a single bearing and at the other end by a duplex bearing.

61. The rotary machine of claim 59 wherein said shaft is rotatably supported within said housing at one end by a duplex bearing and at the other end by a single bearing.

62. The rotary machine of claim 59 and in addition, a bi-directional inverter to provide power to said motor or extract power from said generator.

63. The rotary machine of claim 62 wherein electrical power is utilized to produce fluid power when the fluid supplied to the inlet of the crossing spiral compressor/turbine is at a lower pressure than that needed at the outlet of the crossing spiral compressor/turbine.

64. The rotary machine of claim 62 wherein electrical power is generated when the fluid supplied to the inlet of the crossing spiral compressor/pump/turbine is at a greater pressure than that needed at the outlet of the crossing spiral compressor/pump/turbine.

65. The rotary machine of claim 62 wherein the rotary machine transitions smoothly from generating electrical power while expanding or depressurizing the fluid to utilizing electrical power to compress or pressurize the fluid in response to changes in the supplied inlet fluid pressure and/or the required outlet fluid pressure.

66. A method of compressing fluid comprising the steps of:

providing a stator housing having a central bore with a plurality of fluid flow channels spiraling in a first direction, said plurality of stator housing bore fluid flow channels separated by blades which are significantly narrower than the width of said stator housing bore fluid flow channels;

rotatably supporting a rotor within said central bore of said stator housing, said rotor with a plurality of fluid flow channels spiraling in a second direction opposite to said first direction, said plurality of rotor fluid flow channels separated by blades which are significantly narrower than the width of said rotor fluid flow channels; and rotating said rotor within said stator housing bore with the fluid flow in said plurality of stator housing bore fluid flow channels crossing the fluid flow in said plurality of rotor fluid flow channels.

* * * * *